US007255500B2

(12) United States Patent
Kido et al.

(10) Patent No.: US 7,255,500 B2
(45) Date of Patent: Aug. 14, 2007

(54) HEAT DEVELOPING METHOD AND HEAT DEVELOPING APPARATUS

(75) Inventors: Kazuhiro Kido, Hino (JP); Mamoru Umeki, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/264,932

(22) Filed: Nov. 1, 2005

(65) Prior Publication Data

US 2006/0098079 A1 May 11, 2006

(30) Foreign Application Priority Data

| | | |
|---|---|---|
| Nov. 5, 2004 | (JP) | 2004-322122 |
| Nov. 5, 2004 | (JP) | 2004-322124 |
| Nov. 11, 2004 | (JP) | 2004-327337 |
| Dec. 22, 2004 | (JP) | 2004-371259 |
| Dec. 22, 2004 | (JP) | 2004-371260 |

(51) Int. Cl.
*G03D 13/00* (2006.01)

(52) U.S. Cl. ..... 396/575; 219/216

(58) Field of Classification Search ..... 396/575; 430/348, 350; 355/27; 219/216
See application file for complete search history.

(56) References Cited

U.S. PATENT DOCUMENTS 6,007,971 A * 12/1999 Star et al. ..... 430/350
6,146,028 A * 11/2000 Preszler ..... 396/575
6,312,170 B1 * 11/2001 Agano ..... 396/575
6,320,642 B1 * 11/2001 Ogawa et al. ..... 355/27
6,812,946 B2 * 11/2004 Torisawa et al. ..... 347/228

FOREIGN PATENT DOCUMENTS

JP 10-500497 A 1/1998
JP 2003-287862 A 10/2003

* cited by examiner

*Primary Examiner*—Alan Mathews
(74) *Attorney, Agent, or Firm*—Frishauf, Holtz, Goodman & Chick, P.C.

(57) ABSTRACT

The present invention provides a heat developing method and a heat developing apparatus for stabilizing density and making image quality stable when executing a heat developing process by a rapid process of 10 seconds or less. The heat developing method is a method for heating a film with a heat developing photosensitive material coated on one side of a support base thereof for a heating time of 10 seconds or less and then cooling it, which opens the face side of the film with the heat developing photosensitive material coated, heats it from the support base side, and cools it from the supports base side by opening the side of the film where the heat developing photosensitive material is coated.

7 Claims, 13 Drawing Sheets

FIG. 8 ( b )
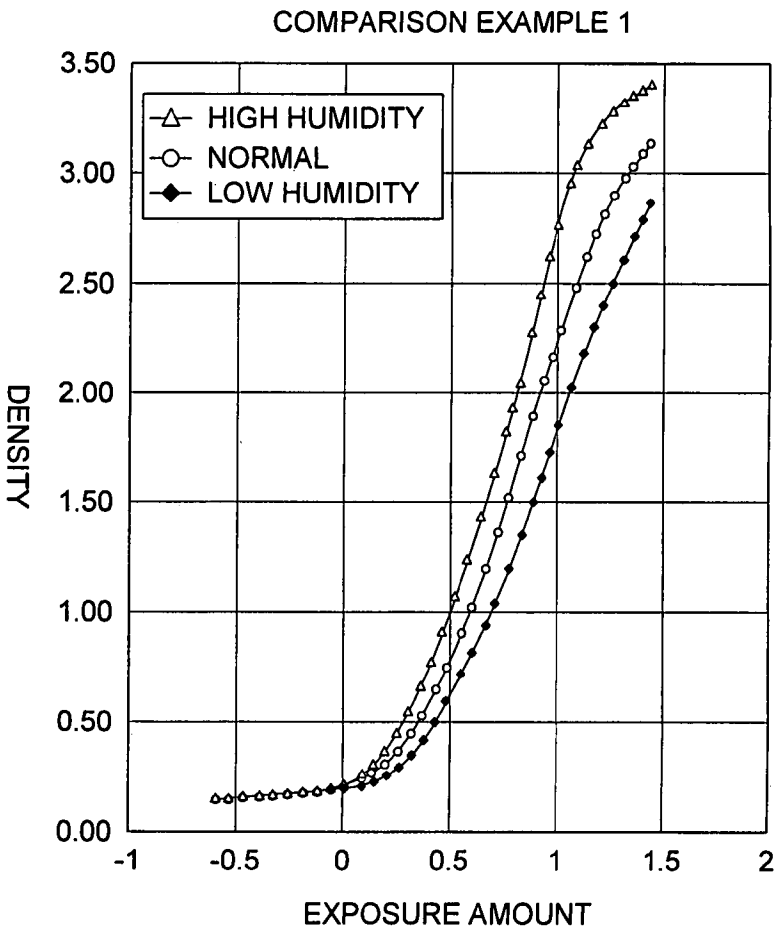
FIG. 8 ( a )
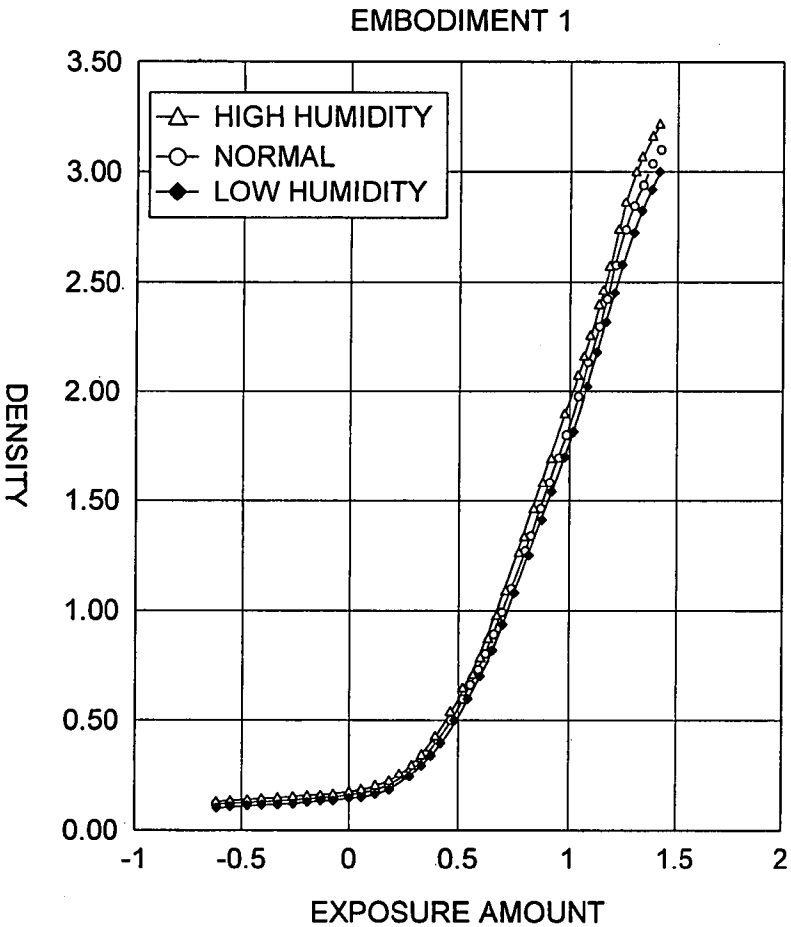

FIG. 9 ( b )
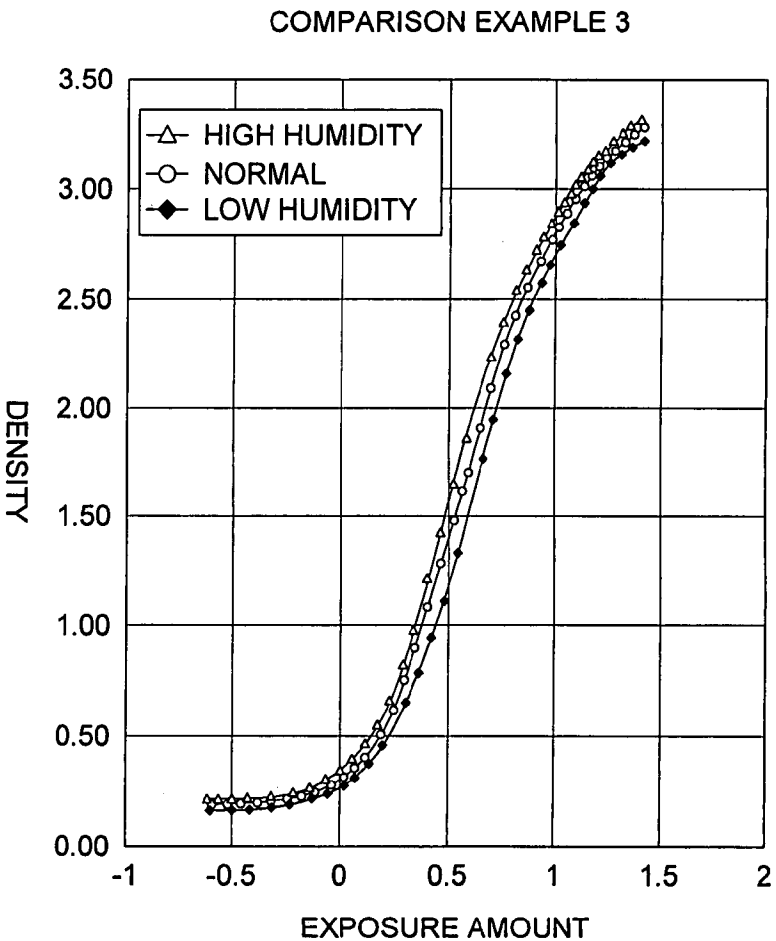
FIG. 9 ( a )
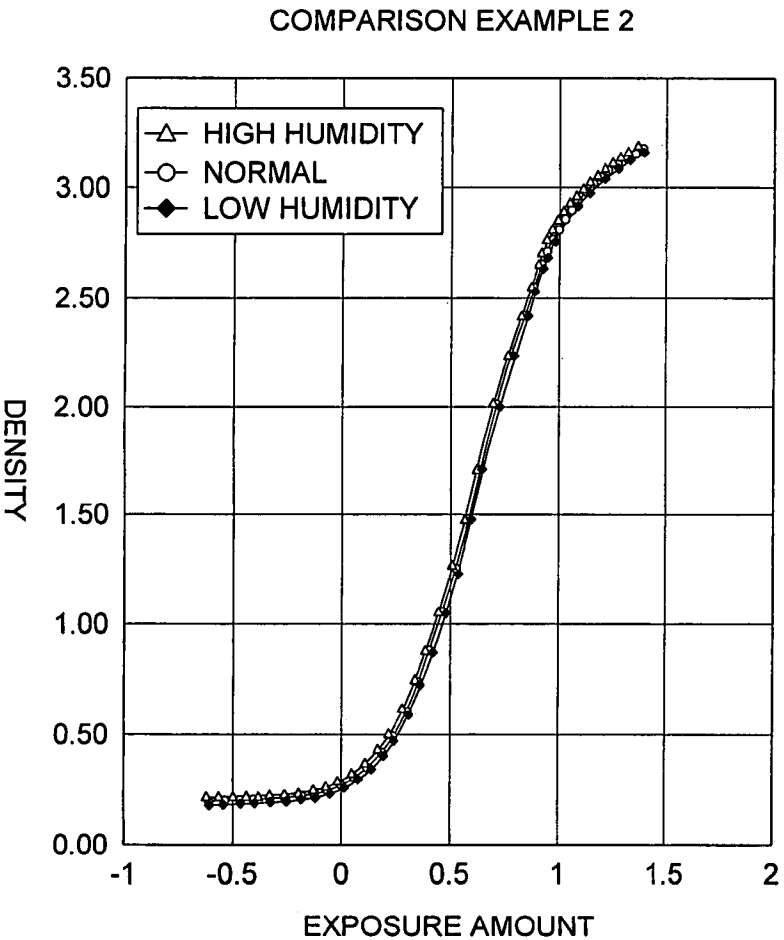

FIG. 14 ( a )
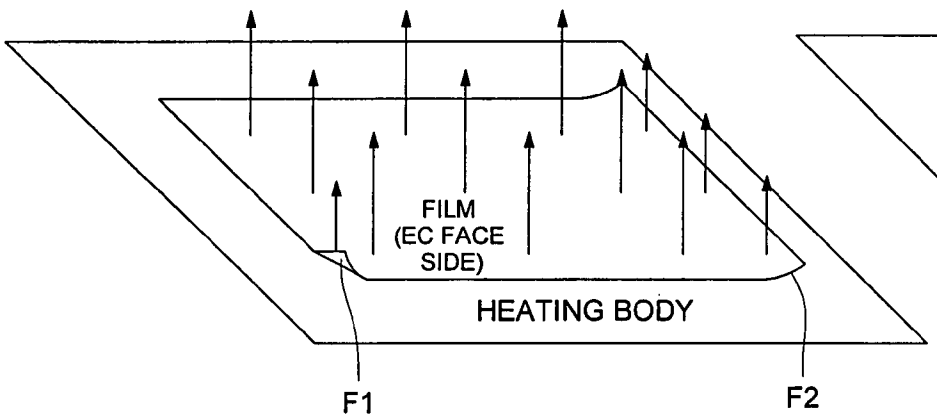
FIG. 14 ( b )
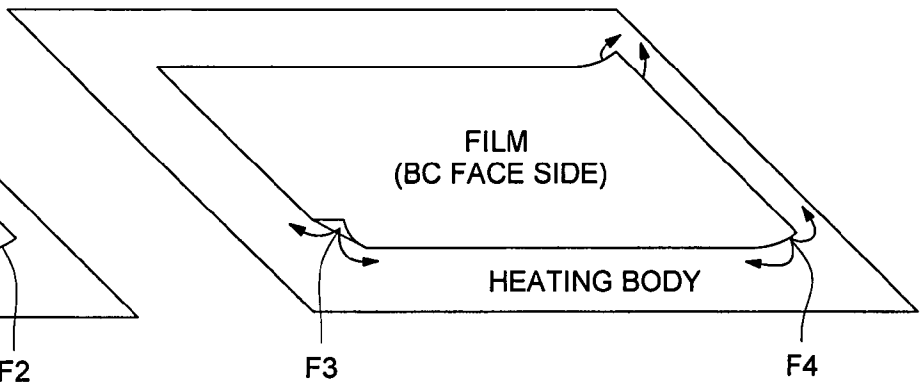

HEAT DEVELOPING METHOD AND HEAT DEVELOPING APPARATUS

This application is based on Japanese Patent Application No. 2004-322122 filed on Nov. 5, 2004, No. 2004-322124 filed on Nov. 5, 2004, No. 2004-327337 filed on Nov. 11, 2004, No. 2004-371259 filed on Dec. 22, 2004 and No. 2004-371260 filed on Dec. 22, 2004, in Japanese Patent Office, the entire content of which is hereby incorporated by reference.

BACKGROUND OF THE INVENTION

1. Field of the Invention

The present invention relates to a heat developing method and a heat developing apparatus for a rapid process by heating and then cooling a sheet film with a heat developing photosensitive material coated.

2. Description of the Related Art

Patent Document 1 indicated below discloses a heat developing apparatus for sliding and heating a sheet film on the EC (emulsion coated) side between a heating drum (heated) having a flexible layer and a plurality of opposing rollers, thereby developing a film with a latent image formed. Patent Document 2 indicated below discloses a heat developing apparatus of a method of using a fixed heater divided into three parts instead of the heating drum aforementioned and sliding and heating the BC (back coated) side of a film on the heater.

In a conventional heat developing apparatus, the heat developing time is generally 14 seconds or so (a length of 17 inches in the conveying direction), though realization of a faster heat developing process and higher image quality is required. However, in Patent Documents 1 and 2, no measures for a rapid heat developing process are suggested and disclosed.

Patent Document 1: Japanese Patent Application Laid-Open Announcement 10-500497

Patent Document 2: Japanese Patent Application Laid-Open 2003-287862

SUMMARY OF THE INVENTION

The present invention is originated to eliminate the difficulties of the prior arts mentioned above and is intended to provide a heat developing method and a heat developing apparatus, when executing a heat developing process by a rapid process of 10 seconds or less, for stabilizing the density and making the image quality stable.

The heat developing apparatus of the present invention is a heat developing apparatus for heating a sheet film with a heat developing photosensitive material coated on one side of a support base for a heating time of 10 seconds or less by a heating section and then cooling it by a cooling section, which is characterized in that the heating section is structured so as to open the side of the sheet film where the heat developing photosensitive material is coated (herein after: EC side) and heat the sheet film from the support base side (hereinafter: BC side) and conveys the heated sheet film to the cooling section by opening the EC side, and the cooling section is structured so as to cool the sheet film from the BC side by opening the EC side.

Further, the heat developing apparatus of the present invention is characterized in that it is structured so as to convey the sheet film to the cooling section by opening the EC side in the upward direction opposite to the gravity direction.

According to the heat developing apparatus, when executing the heat developing process by the rapid process of 10 seconds or less, the EC side is opened, and the sheet film is heated from the BC side, thus the solvents (moisture, organic solvent, etc.) contained in the sheet film which are heated and are intended to volatilize (evaporate) are almost scattered out at the shortest distance, so that even if the heating time (volatilization time) is shortened, the sheet film is unlikely to be affected by the shortened time, and the image quality is stabilized, and even if there is a part where the contact between the film and the heating body is not enough, a density difference from the part where the contact is satisfactory is unlikely to appear, so that the density can be stabilized, and the image quality becomes stable. Further, after end of the heating step, the sheet film is cooled from the support body face by opening the EC side, and moreover the EC side is opened between the heating section and the cooling section, so that the solvents (moisture, organic solvent, etc.) still at a high temperature which are intended to volatilize (evaporate) are not trapped and are volatilized for a longer period of time, so that the image quality (density, γ curve) is stabilized. In the rapid process, this time cannot be ignored and it is particularly valid in a rapid process of a heating time of 10 seconds or less.

Further, according to this developing apparatus, the aforementioned heat developing method can be executed, and the EC side is opened, and the sheet film is heated from the BC side, and the heated sheet film is conveyed to the cooling section by opening the EC side in the upward direction opposite to the gravity direction, thus the solvents are easily volatilized at the shortest distance from the sheet film heated during the conveyance of heating and cooling, and a difference is unlikely to appear in the density, and the density is stabilized more.

Furthermore, according to this developing apparatus, in the heat developing apparatus aforementioned, by opening the EC side in the upward direction opposite to the gravity direction, the sheet film is conveyed outside the apparatus from the cooling section, thus the solvents are continuously volatilized at the shortest distance from the sheet film between cooling and outside conveyance, and a difference is more unlikely to appear in the density, and the density is stabilized more.

In the heat developing apparatus aforementioned, the cooling section is preferably structured at least on the sheet film entering side so as to open the EC side. On the sheet film entering side, the solvents (moisture, organic solvent, etc.) are still at a high temperature, as the EC side is opened, the solvents are not trapped and can be volatilized for a longer period of time.

Further, the heating section is structured so as to execute the temperature raising step of raising the sheet film to the heat developing temperature and the temperature retaining step of retaining the temperature of the sheet film raised to the heat developing temperature, thus uneven density is more unlikely to be generated.

Further, the aforementioned means of the present invention may be all executed or by execution of only a part thereof, the problems aforementioned can be solved.

According to the heat developing method and heat developing apparatus of the present invention, when executing the heat developing process by the rapid process of 10 seconds or less, the density can be stabilized and the image quality can be made stable. Further, in consideration of stable conveyance of sheet films, the lower limit of the heating time is about 5 seconds.

BRIEF DESCRIPTION OF THE DRAWINGS

FIG. 8 is drawings showing the sensitocurve (γ curve) indicating the relationship between the exposure amount and the density of Example 1(a) and Comparison Example 1(b) of the rapid process.

FIG. 9 is drawings showing the sensitocurve (γ curve) indicating the relationship between the exposure amount and the density of Comparison Examples 2(a) and 3(b) of the normal process.

FIG. 14(*a*) is a drawing schematically showing the situation of opening of the EC side of the sheet film and heating of the BC side FIG. 14(*b*) is a drawing schematically showing, for comparison, the situation of opening of the BC side of the sheet film and heating of the EC side.

DETAILED DESCRIPTION OF THE PREFERRED EMBODIMENTS

Figure 1:
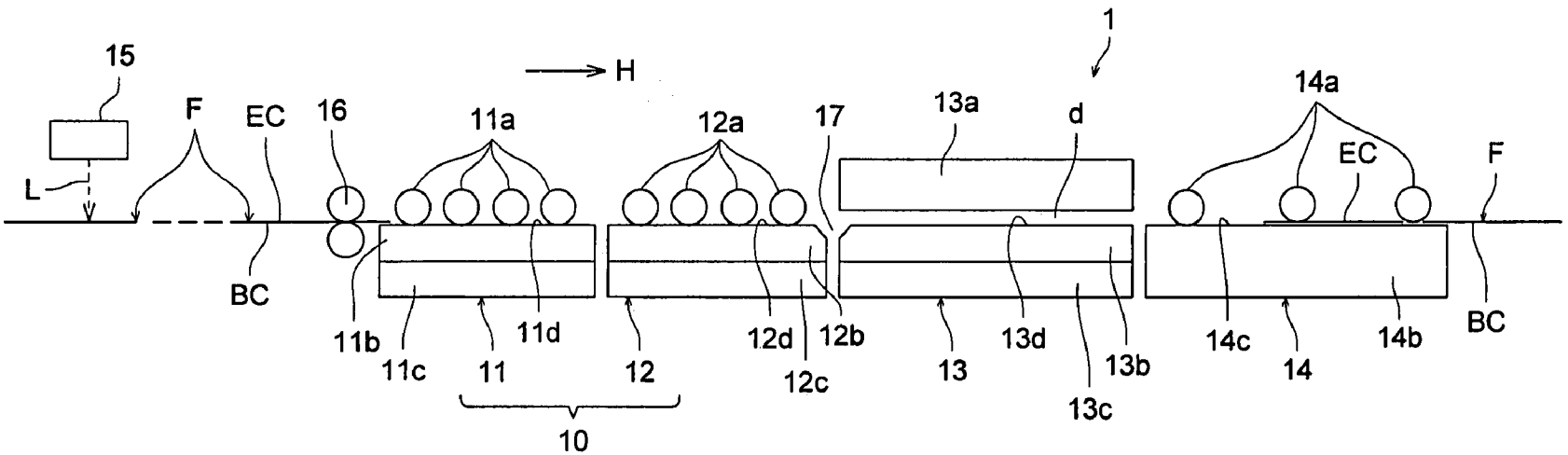
FIG. 1 is a front view schematically showing the essential section of the heat developing apparatus of the first embodiment.

To accomplish the above object, the inventor, after a result of diligent examination and research, obtains the following knowledge. Namely, the knowledge is that if the heating time of a sheet film with a latent image formed is 14 seconds or so, by heating from the EC side and also heating from the BC side, the solvent components (MEK, moisture, etc.) contained in the emulsion are almost volatilized (evaporated), so that the image quality (density) is stabilized, while in the rapid process for shortening the heating time, between heating of the EC side and heating of the BC side, a difference appears in the density.

Furthermore, by the examination of the inventor, knowledge is obtained that a sheet film is heated from the BC side and the heated sheet film is conveyed to the cooling step with the EC side being opened, thus the volatilization from the sheet film heated during the conveyance of heating and cooling is not suppressed, and a difference is unlikely to appear in the density, and the density is stabilized more.

The effect of opening of the EC side of the sheet film and heating of the BC side will be explained by referring to FIGS. 14(*a*) and (*b*). FIG. 14(*a*) is a drawing schematically showing the situation of opening of the EC side of the sheet film and heating of the BC side and FIG. 14(*b*) is a drawing schematically showing, for comparison, the situation of opening of the BC side of the sheet film and heating of the EC side.

(A) Stability of the Density and Stability of the Sensitocurve (γ Curve)

When many films are stacked and set in the apparatus, the films absorb moisture from the uppermost film, the lowermost film, and the film edges of the four peripheries due to the environmental humidity and volatilize the residual solvents therein. Therefore, between the stacked film faces and in each film face, the contents of the solvents (moisture, organic solvent) become ununiform. Such ununiformity of the solvent contents between the film faces remains in the films after heating, and due to the ununiformity, a density difference appears between prints in one day and between days, and as the processing speed is increased, the density differences are apt to become more remarkable. However, in the rapid process (the heating time is shortened) method of the present invention by opening the EC side, the solvent components are volatilized uniformly in a short time, so that the density difference is unlikely to appear. As a result, the density is stabilized, and the sensitocurve (γ curve) is stabilized, and the density gradation is stabilized.

(B) Uniformity of the Density (1) When many films are stacked and set in the apparatus, the films absorb moisture from the uppermost film, the lowermost film, and the film edges of the four peripheries due to the environmental humidity and volatilize the residual solvents therein. Therefore, between the stacked film faces and in the film faces, the contents of the solvents (moisture, organic solvent) become ununiform. In the four peripheries of the films, the solvent content is apt to become ununiform, and an intra-face density difference appears, and uneven density is generated. However, by the rapid process (the heating time is shortened) by opening the EC side of the present invention, the solvent components are uniformly volatilized overall the films, thus the density difference of the film is unlikely to appear.

(C) Uniformity of the Density (2) Even if the contact (heat conductivity) between the film (substrate of PET) and the heater gets worse partially, the PET base performs the relaxation action of uneven heat conduction, so that the occurrence of uneven density can be suppressed.

In the case of opening the EC side and heating the BC side shown in FIG. 14(*a*), the EC side of the sheet film is opened, so that the solvents (moisture, organic solvent) are volatilized from overall the film, and the density is lowered, though at the parts F1 and F2 where the contact between the film and the heating body is bad partially, the volatilization amount is reduced relatively, and the density reduction amount is reduced, and on the other hand, the temperature is unlikely to be increased relatively, and the development progress is suppressed, and the density is lowered. These offset each other, so that a density difference is unlikely to appear in the place of good contact. As a result, the uniformity of density in a film is better.

On the other hand, in a case of opening the BC side and heating the EC side shown in FIG. 14(*b*), from the parts F3 and F4 where the contact between the film and the heating body is bad partially, the solvents (moisture, organic solvent) are volatilized and the density is lowered, and on the other hand, at the parts F3 and F4 where the contact between the film and the heating body is bad partially, the temperature is unlikely to be increased, and the development progress is suppressed, and the density is lowered. By the synergistic effect thereof, a density difference from the place of good contact is discriminated. As a result, the intra-face uniformity due to uneven density becomes disadvantageous.

Furthermore, until cooling after heating, the solvents (moisture, organic solvent) at a high temperature are intended to volatilize (evaporate), so that the solvents are not trapped and are volatilized for a longer period of time, thus the image quality (density, γ curve) is stabilized. In the rapid process, this time cannot be ignored and it is particularly valid in a rapid process of a heating time of 10 seconds or less.

The present invention was originated on the basis of the aforementioned knowledge of the inventor and to solve the aforementioned problems, the present invention has the following means. The heat developing method of the present invention is a heat developing method for heating a sheet film with a heat developing photosensitive material coated on one side of a support base for a heating time of 10 seconds or less and then cooling it, which is characterized in that it opens the EC side, heats the sheet film from the BC side, and cools the sheet film from the support body face by opening the EC side.

Further, as another means of the present invention, the heat developing method of the present invention is a heat developing method for heating a sheet film with a heat developing photosensitive material coated on one side of a support base for a heating time of 10 seconds or less and then cooling it, which is characterized in that it opens the EC side, heats the sheet film from the BC side, and conveys the heated sheet film to a cooling step by opening the EC side.

Furthermore, as still another means of the present invention, the heat developing method of the present invention is a heat developing method for heating a sheet film with a heat developing photosensitive material coated on one side of a support base for a heating time of 10 seconds or less by a heating section and then conveying it to a cooling section, which is characterized in that it opens the EC side, heats the sheet film from the BC side, and conveys the sheet film to the cooling section by opening the EC side in the upward direction opposite to the gravity direction.

If the heating time of a sheet film having a formed latent image is 14 seconds or so, by heating from the EC side and also heating from the BC side, the solvent components (MEK, moisture, etc.) contained in the coated material are almost volatilized (evaporated) out, so that the image quality (density) is stabilized, while in the rapid process for shortening the heating time to 10 seconds or less, between heating of the EC side and heating of the BC side, a difference appears in the density. However, in the heat developing method of the present invention, the EC side is opened, and the sheet film is heated from the BC side, and the heated sheet film is conveyed to the cooling step by opening the EC side in the upward direction opposite to the gravity direction, thus the solvents are easily volatilized at the shortest distance from the sheet film heated during the conveyance of heating and cooling, and a difference is unlikely to appear in the density, and the density is stabilized more.

According to the heat developing method, when executing the heat developing process by the rapid process of 10 seconds or less, the EC side is opened, and the sheet film is heated from the BC side, thus the solvents (moisture, organic solvent, etc.) contained in the sheet film which are heated and intended to volatilize (evaporate) are scattered at the shortest distance, so that even if the heating time (volatilization time) is shortened, the sheet film is unlikely to be affected by the shortened time, and the image quality is stabilized, and even if there is a part where the contact between the film and the heating body is not enough, a density difference from the part where the contact is satisfactory is unlikely to appear, so that the density can be stabilized, and the image quality becomes stable. Further, the sheet film is cooled from the support body face by opening the EC side, and moreover the EC side is opened between the heating step and the cooling step, so that the solvents (moisture, organic solvent, etc.) still at a high temperature which are intended to volatilize (evaporate) are not trapped and are volatilized for a longer period of time, thus the image quality (density, γ curve) is stabilized. In the rapid process, this time cannot be ignored and it is particularly valid in a rapid process of a heating time of 10 seconds or less.

Further, according to the developing method aforementioned, the sheet film is conveyed outside the cooling section by opening the EC side in the upward direction opposite to the gravity direction, so that the solvents are continuously volatilized at the shortest distance from the sheet film between cooling and outside conveyance, and a difference is more unlikely to appear in the density, and the density is stabilized more.

In the heat developing method aforementioned, it is preferable at time of cooling at least on the sheet film entering side to open the EC side. On the entering side of the sheet film, the solvents (moisture, organic solvent, etc.) are still at a high temperature, as the EC side is opened, the solvents are not trapped and can be volatilized for a longer period of time.

Further, the heating step includes a temperature raising step of raising the temperature of the sheet film to the develop initiating temperature and a temperature retaining step of retaining the temperature of the sheet film raised to the heat developing temperature, thus uneven density is more unlikely to be generated.

Hereinafter, the preferred embodiments for execution of the present invention will be explained with reference to the accompanying drawings.

First Embodiment

FIG. 1 is a side view schematically showing the essential section of the heat developing apparatus of the first embodiment. As shown in FIG. 1, a heat developing apparatus 1 of the first embodiment, by sub-scanning and conveying a sheet film F (hereinafter, referred to as a film) having an EC side on one side of a sheet support base made of PET and a BC side of the opposite face of the EC side in the direction H, scans and exposes a laser beam L by an optical scanning exposure unit 15 on the basis of image data, thereby forms a latent image on the EC side, then heats and develops the film F from the BC side, and makes the latent image visible.

The heat developing apparatus 1 shown in FIG. 1 includes a temperature raising unit 10 for heating the film F having a formed latent image from the BC side and raising it up to a predetermined heat developing temperature, a temperature retaining unit 13 for heating and retaining the film at the predetermined heat developing temperature, and a cooling unit 14 for cooling the heated film F from the BC side. The temperature raising unit 10 and the temperature retaining unit 13 compose a heating unit, which heats the film F up to the heat developing temperature and retains it at the heat developing temperature.

The temperature raising unit 10 has a first heating zone 11 for heating the film F on the upstream side and a second heating zone 12 for heating it on the downstream side.

The first heating zone 11 includes a fixed flat heating guide 11*b* made of a metallic material such as aluminum, a flat heater 11*c* composed of a silicone rubber heater adhered to the rear of the heating guide 11*b*, and a plurality of opposing rollers 11*a* having a surface composed of silicone rubber insulating more than metal arranged on a fixed guide face 11*d* of the heating guide 11*b* so as to keep a narrower gap than the film thickness in order to press the film.

The second heating zone 12 includes a fixed flat heating guide 12*b* made of a metallic material such as aluminum, a flat heater 12*c* composed of a silicone rubber heater adhered to the rear of the heating guide 12*b*, and a plurality of opposing rollers 12*a* having a surface composed of silicone rubber insulating more than metal arranged on a fixed guide face 12*d* of the heating guide 12*b* so as to keep a narrower gap than the film thickness in order to press the film.

The temperature retaining unit 13 includes a fixed flat heating guide 13*b* made of a metallic material such as aluminum, a flat heater 13*c* composed of a silicone rubber heater adhered to the rear of the heating guide 13*b*, and a guide section 13*a* composed of a heat insulating material arranged opposite to a fixed guide face 13*d* formed on the surface of the heating guide 13*b* so as to have a predetermined gap (slit) d.

In the first heating zone 11 of the temperature raising unit 10, the film F conveyed by a pair of conveying rollers 16 from the upstream side of the temperature raising unit 10 is compressed against the fixed guide face 11*d* by the respective opposing rollers 11*a* driven to rotate, thus the BC side makes close contact with the fixed guide face 11*d* and is conveyed in the direction H by being heated.

Similarly in the second heating zone 12, the film F conveyed from the first heating zone 11 is compressed against the fixed guide face 12*d* by the respective opposing rollers 12*a* driven to rotate, thus the BC side makes close contact with the fixed guide face 11*d* and is conveyed in the direction H by being heated.

Between the second heating zone 12 of the temperature raising unit 10 and the temperature retaining unit 13, a concavity 17 opened upward in a V shape is installed and is structured so that foreign substances from the temperature raising unit 10 fall into the concavity 17. By doing this, foreign substances from the temperature raising unit 10 are prevented from being carried in the temperature retaining unit 13 and the film F can be prevented from an occurrence of jamming, scratching, and density irregularities.

In the temperature retaining unit 13, the film F conveyed from the second heating zone 12 passes through the gap d by the conveying force of the opposing rollers 12*a* on the side of the second heating zone 12 by being heated (heat retained) by the heat from the heating guide 13*b* in the gap d between the fixed guide face 13*d* of the heating guide 13*b* and the guide section 13*a*.

In the cooling unit 14, the film F makes contact with a cooling guide face 14*c* of a cooling plate 14*b* made of a metallic material and is conveyed moreover in the direction H by opposing rollers 14*a* by being cooled. Further, when the cooling plate 14*b* is formed as a finned heat sink structure, the cooling effect can be increased. A cooling plate of a finned heat sink structure may be arranged additionally on the downstream side of the cooling plate 14*b*.

As mentioned above, in the heat developing apparatus 1 shown in FIG. 1, the film F is conveyed when the BC side is directed toward the fixed guide faces 11*d*, 12*d*, and 13*d* in a heated state in the temperature raising unit 10 and the temperature retaining unit 13 and the EC side is in an opened state. Further, in the cooling unit 14, as shown by an alternate long and short dash line, the film F is conveyed when the BC side makes contact with the cooling guide face 14*c* and is cooled and the EC side is opened.

Further, the film F is conveyed by the opposing rollers 11*a* and 12*a* so that the passing time through the temperature raising unit 10 and the temperature retaining unit 13 becomes 10 seconds or less. Therefore, the heating time for temperature raising and temperature retaining is set to 10 seconds or less.

As mentioned above, according to the heat developing apparatus 1 shown in FIG. 1, in the temperature raising unit 10 requiring uniform heat transfer, by the heating guides 11*b* and 12*b* and the plurality of opposing rollers 11*a* and 12*a* for compressing the film F against the heating guides 11*b* and 12*b*, the film F is adhered to the fixed guide faces 11*d* and 12*d*, thus the film F is conveyed by ensuring contact heat transfer. Therefore, overall the film is heated uniformly and is uniformly raised in temperature, thus the finished film forms a high-quality image with an occurrence of uneven density suppressed.

Further, after temperature raising to the heat developing temperature, even if the temperature retaining unit 13 conveys the film into the gap d between the fixed guide face 13*d* of the heating guide 13*b* and the guide section 13*a* and heats (the film directly makes contact with the fixed guide face 13*d* and is heated by heat transfer and/or heat transfer by contact with surrounding high-temperature air) in the gap d without particularly being adhered to the fixed guide face 13*d*, the film temperature is controlled within a predetermined range (for example, 0.5° C.) of the developing temperature (for example, 123° C.). As mentioned above, even if the film is conveyed in the gap d along the wall face of the heating guide 13*b* or the wall face of the guide section 13*a*, a difference in the film temperature is less than 0.5° C. and a uniform temperature retaining state can be kept, so that there is little fear of an occurrence of uneven density in the finished film. Therefore, there is no need to install drive parts such as rollers in the temperature retaining unit 13, thus the number of parts can be reduced.

Furthermore, the heating time for the film F is 10 seconds or less, so that a rapid heat developing process can be realized, and the film conveying path linearly extended from the temperature raising unit 10 to the cooling unit 14 can be changed according to the apparatus layout, and miniaturization of the installation area and miniaturization of the overall apparatus can be realized.

In a conventional large-sized apparatus, for the part operated sufficiently by the temperature retaining function after the film is raised to the developing temperature, the same heating conveying constitution as that of the temperature raising unit is adopted, so that unnecessary members are used after all, and increasing in the number of parts and increasing in cost are caused, and in a conventional small-sized apparatus, a problem arises that heat transfer at time of temperature raising cannot be guaranteed, so that density irregularities are caused, and high image quality can be unlikely to be guaranteed. On the other hand, according to the first embodiment, the heat developing process is executed separately in the temperature raising unit 10 and the temperature retaining unit 13, thus the problems aforementioned can be dissolved.

Further, the film F is heated from the BC side by the temperature raising unit 10 and the temperature retaining unit 13 when the EC side is opened, thus when executing the heat developing process by the rapid process of 10 seconds or less, by opening the EC side, the solvents (moisture, organic solvent, etc.) contained in the film F which are heated and intended to volatilize (evaporate) are scattered at the shortest distance, so that even if the heating time (volatilization time) is shortened, the sheet film is unlikely to be affected by the shortened time, and even if there is a part where the contact between the film F and the fixed guide faces 11*d* and 12*d* is not enough, by the heat diffusion effect by the PET base of the BC side, a temperature difference from the part where the contact is satisfactory is relaxed, and as a result, a density difference is unlikely to appear, so that the density can be stabilized, and the image quality becomes stable. Further, generally, in consideration of the heating efficiency, heating the EC side is considered to be better. However, in consideration of that the thermal conductivity of the PET of the support base of the film F is 17 W/m ° C. and the thickness of the PET base is about 170 μm, the time delay is a little, and it can be offset easily by increasing the heater capacity, and the aforementioned effect of relaxing uneven contact can be expected preferably.

Furthermore, between the temperature retaining unit 13 and the cooling unit 14, the solvents (moisture, organic solvent, etc.) contained in the film F are intended to volatilize (evaporate) because they are at a high temperature, though the EC side of the film F is opened in the cooling unit 14, so that the solvents (moisture, organic solvent, etc.) are not trapped and are volatilized for a longer period of time, so that the image quality (density) is stabilized more. As mentioned above, in the rapid process, the cooling time cannot be ignored and it is particularly valid in a rapid process of a heating time of 10 seconds or less.

Second Embodiment

Figure 2:
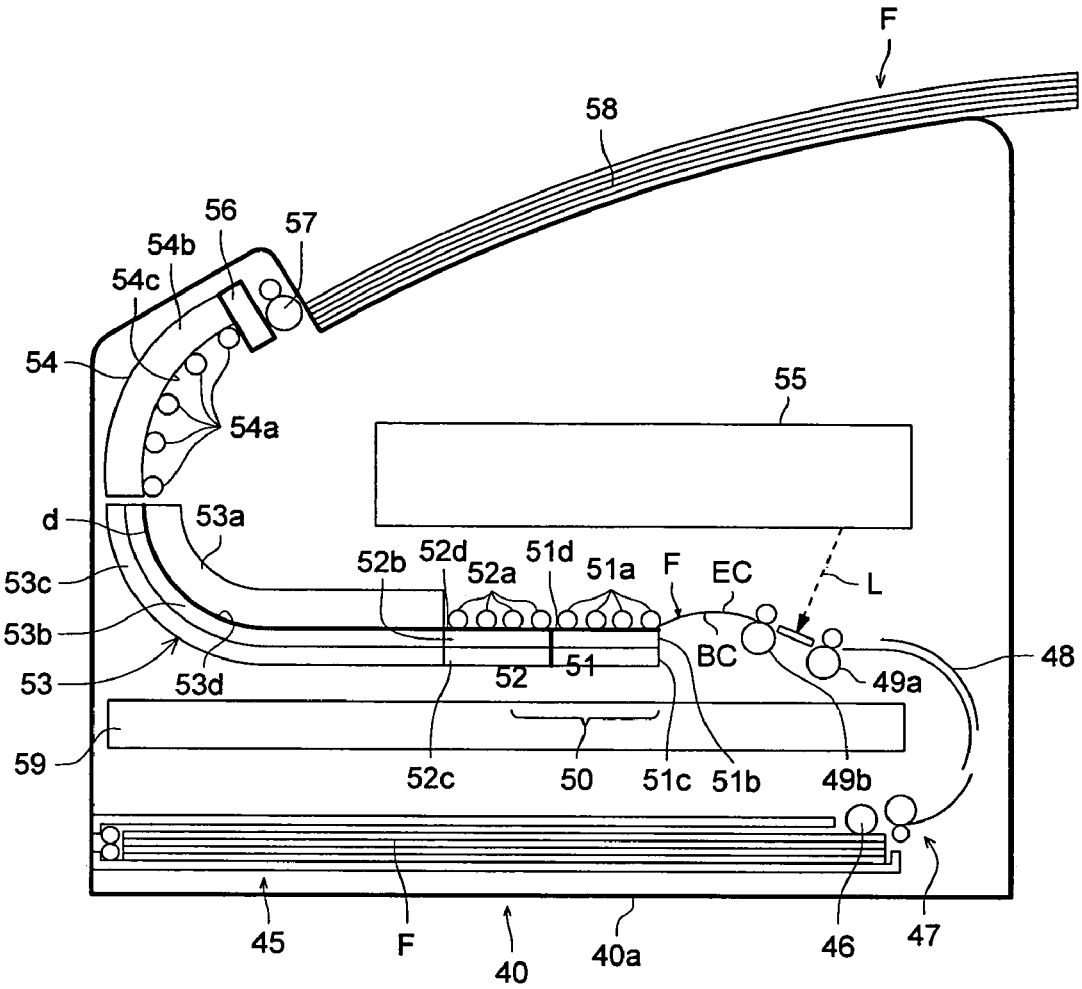
FIG. 2 is a front view schematically showing the essential section of the heat developing apparatus of the second embodiment.

FIG. 2 is a side view schematically showing the essential section of the heat developing apparatus of the second embodiment.

As shown in FIG. 2, a heat developing apparatus 40 of the second embodiment, similarly to the aforementioned, by sub-scanning and conveying the sheet film F having the EC side on one side of the sheet support base made of PET and the BC side of the opposite face of the EC side, forms a latent image on the EC side by a laser beam L from an optical scanning exposure unit 55, then heats and develops the film F from the BC side, makes the latent image visible, and conveys and ejects it above the apparatus via the curved conveying path.

The heat developing apparatus 40 shown in FIG. 2 includes a film storage unit 45 for storing many unused films F installed in the neighborhood of the bottom of an apparatus frame 40*a*, a pickup roller 46 for picking up and conveying the uppermost film F of the film storage unit 45, a pair of conveying rollers 47 for conveying the films F from the pickup roller 46, a curved guide 48 formed in a curved shape so as to guide the films F from the pair of conveying rollers 47 and convey them by almost inverting the conveying direction, a pair of conveying rollers 49*a* and 49*b* for sub-scanning and conveying the films F from the curved guide 48, and an optical scanning exposure unit 55 for scanning and exposing a laser beam L to the films F between the pair of conveying rollers 49*a* and 49*b* on the basis of the image data, thereby forming a latent image on the EC side.

The heat developing apparatus 40 additionally includes a temperature raising unit 50 for heating the film F with the latent image formed from the BC side and raising the temperature up to a predetermined heat developing temperature, a temperature retaining unit 53 for heating the temperature-raised film F and retaining the film at the predetermined heat developing temperature, a cooling unit 54 for cooling the heated film F from the BC side, a densitometer 56 arranged on the exit side of the cooling unit 54 for measuring the density of the film F, a pair of conveying rollers 57 for ejecting the film F from the densitometer 56, and a film receiving unit 58 installed on the top of the apparatus frame 40*a* with a gradient so as to load the film F ejected by the pair of conveying rollers 57.

As shown in FIG. 2, in the heat developing apparatus 40, upward from the bottom of the apparatus frame 40*a*, the film storage unit 45, control unit 59, conveying roller pair 49*a* and 49*b*, temperature raising unit 50, and temperature retaining unit 53 (on the upstream side) are arranged in this order, and the film storage unit 45 is positioned lowest, and the control unit 59 is installed between the temperature raising unit 50 and the temperature retaining unit 53, so that the film storage unit is unlikely to be affected by heat.

Further, the conveying path from the pair of conveying rollers 49*a* and 49*b* for sub-scanning and conveying to the temperature raising unit 50 is formed comparatively short, so that by exposing the film F by the optical scanning exposure unit 55, on the front end side of the film F, the temperature raising unit 50 and the temperature retaining unit 53 execute heat developing heating.

The temperature raising unit 50 and the temperature retaining unit 53 compose a heating unit, which heats the film F up to the heat developing temperature and retains it at the heat developing temperature. The temperature raising unit 50 has a first heating zone 51 for heating the film F on the upstream side and a second heating zone 52 for heating it on the downstream side.

The first heating zone 51 includes a fixed flat heating guide 51*b* made of a metallic material such as aluminum, a flat heater 51*c* composed of a silicone rubber heater adhered to the rear of the heating guide 51*b*, and a plurality of opposing rollers 51*a* having a surface composed of silicone rubber insulating more than metal arranged on a fixed guide face 51*d* of the heating guide 51*b* so as to keep a narrower gap than the film thickness in order to press the film.

The second heating zone 52 includes a fixed flat heating guide 52*b* made of a metallic material such as aluminum, a flat heater 52*c* composed of a silicone rubber heater adhered to the rear of the heating guide 52*b*, and a plurality of opposing rollers 52*a* having a surface composed of silicone rubber insulating more than metal arranged on a fixed guide face 52*d* of the heating guide 52*b* so as to keep a narrower gap than the film thickness in order to press the film.

The temperature retaining unit 53 includes a fixed flat heating guide 53*b* made of a metallic material such as aluminum, a flat heater 53*c* composed of a silicone rubber heater adhered to the rear of the heating guide 53*b*, and a guide section 53*a* which is arranged opposite to a fixed guide face 53*d* formed on the surface of the heating guide 53*b* so as to have a predetermined gap (slit) d and is composed of a heat insulating material. In the temperature retaining unit 53, the part thereof on the side of the temperature raising unit 50 is formed continuously and flatly with the second heating zone 52 and is formed in a curved shape at a predetermined curvature above the apparatus in the middle thereof.

In the first heating zone 51 of the temperature raising unit 50, the film F conveyed by the pair of conveying rollers 49*a* and 49*b* from the upstream side of the temperature raising unit 50 is compressed against the fixed guide face 51*d* by the respective opposing rollers 51*a* driven to rotate, thus the BC side makes close contact with the fixed guide face 51*d*, and the film F is conveyed by heating the BC side.

Similarly in the second heating zone 52, the film F conveyed from the first heating zone 51 is compressed against the fixed guide face 52*d* by the respective opposing rollers 52*a* driven to rotate, thus the BC side makes close contact with the fixed guide face 51*d*, and the film F is conveyed by heating the BC side.

Further, similarly to FIG. 1, between the second heating zone 52 of the temperature raising unit 50 and the temperature retaining unit 53, a concavity 17 opened upward in a V shape may be installed and foreign substances from the temperature raising unit 50 fall into the concavity, thus foreign substances from the temperature raising unit 50 can be prevented from being carried in the temperature retaining unit 53.

In the temperature retaining unit 53, the film F conveyed from the second heating zone 52 passes through the gap d by the conveying force of the opposing rollers 52*a* on the side of the second heating zone 52 by being heated (heat retained) by the heat from the heating guide 53*b* in the gap d between the fixed guide face 53*d* of the heating guide 53*b* and the guide section 53*a*. At this time, the film F is conveyed toward the cooling unit 54 by being gradually changed in the direction from the horizontal direction to the vertical direction.

In the cooling unit 54, the film F conveyed almost in the vertical direction from the temperature retaining unit 53 is cooled by making contact with a cooling guide face 54*c* of a cooling plate 54*b* made of a metallic material by opposing rollers 54*a* and is conveyed by gradually changing the direction thereof from the vertical direction to the oblique direction toward the film receiving unit 58. Thus, the heat developing apparatus can be compact. Further, when the cooling plate 54*b* is formed as a finned heat sink structure, the cooling effect can be increased. A part of the cooling plate 54 may be formed as a finned heat sink structure.

The cooled film F sent from the cooling unit 54 is measured for density by the densitometer 56, is conveyed by the pair of conveying rollers 57, and is ejected to the film receiving unit 58. The film receiving unit 58 can temporarily load a plurality of films F.

As mentioned above, in the heat developing apparatus 40 shown in FIG. 2, the film F is conveyed when the BC side is directed toward the fixed guide faces 51*d*, 52*d*, and 53*d* in a heated state in the temperature raising unit 50 and the temperature retaining unit 53 and the EC side is in an opened state. Further, in the cooling unit 54, the film F is conveyed when the BC side makes contact with the cooling guide face 54*c* and is cooled and the EC side is opened.

Further, the film F is conveyed by the opposing rollers 51*a* and 52*a* so that the passing time through the temperature raising unit 50 and the temperature retaining unit 53 becomes 10 seconds or less. Therefore, the heating time for temperature raising and temperature retaining is set to 10 seconds or less.

As mentioned above, according to the heat developing apparatus 40 shown in FIG. 2, in the temperature raising unit 50 requiring uniform heat transfer, by the heating guides 51*b* and 52*b* and the plurality of opposing rollers 51*a* and 52*a* for compressing the film F against the heating guides 51*b* and 52*b*, the film F is adhered to the fixed guide faces 51*d* and 52*d*, thus the film F is conveyed by ensuring contact heat transfer. Therefore, overall the film is heated uniformly and is uniformly raised in temperature, thus the finished film forms a high-quality image with an occurrence of uneven density suppressed.

Further, after temperature raising to the heat developing temperature, even if the temperature retaining unit 53 conveys the film into the gap d between the fixed guide face 53*d* of the heating guide 53*b* and the guide section 53*a* and heats (the film directly makes contact with the fixed guide face 53*d* and is heated by heat transfer and/or heat transfer by contact with surrounding high-temperature air) in the gap d without particularly being adhered to the fixed guide face 53*d*, the film temperature is controlled within a predetermined range (for example, 0.5° C.) of the developing temperature (for example, 123° C.). As mentioned above, even if the film is conveyed in the gap d along the wall face of the heating guide 53*b* or the wall face of the curved guide 53*a*, a difference in the film temperature is less than 0.5° C. and a uniform temperature retaining state can be kept, so that there is little fear of an occurrence of uneven density in the finished film. Therefore, there is no need to install drive parts such as rollers in the temperature retaining unit 53, thus the number of parts can be reduced.

Furthermore, the heating time for the film F is 10 seconds or less, so that a rapid heat developing process can be realized, and the temperature retaining unit 53 extended horizontally from the temperature raising unit 50 is structured so as to be formed in a curved shape in the middle thereof and be directed vertically, and the film F is almost inverted in the direction thereof in the cooling unit 54 and is ejected to the film receiving unit 58. Therefore, the cooling unit 54 is formed at a predetermined curvature according to the apparatus layout, thus miniaturization of the installation area and miniaturization of the overall apparatus can be realized.

In a conventional large-sized apparatus, for the part operated sufficiently by the temperature retaining function after films are raised to the developing temperature, the same heating conveying constitution as that of the temperature raising unit is adopted, so that unnecessary members are used after all, and increasing in the number of parts and increasing in cost are caused, and in a conventional small-sized apparatus, a problem arises that heat transfer at time of temperature raising cannot be guaranteed, so that density irregularities are caused, and high image quality can be unlikely to be guaranteed. On the other hand, according to the second embodiment, similarly to the first embodiment, the heat developing process is executed separately in the temperature raising unit 50 and the temperature retaining unit 53, thus the problems aforementioned can be dissolved.

Further, the film F is heated from the BC side by the temperature raising unit 50 and the temperature retaining unit 53 when the EC side is opened, thus when executing the heat developing process by the rapid process of 10 seconds or less, by opening the EC side, the solvents (moisture, organic solvent, etc.) contained in the film F which are heated and intended to volatilize (evaporate) are scattered at the shortest distance, so that even if the heating time (volatilization time) is shortened, the sheet film is unlikely to be affected by the shortened time, and even if there is a part where the contact between the film F and the fixed guide faces 51*d* and 52*d* is not enough, by the heat diffusion effect by the PET base of the BC side, a temperature difference from the part where the contact is satisfactory is relaxed, and as a result, a density difference is unlikely to appear, so that the density can be stabilized, and the image quality becomes stable. Further, generally, in consideration of the heating efficiency, heating of the EC side is considered to be better. However, in consideration of that the thermal conductivity of the PET of the support base of the film F is 17 W/m ° C. and the thickness of the PET base is about 170 μm, the time delay is a little, and it can be offset easily by increasing the heater capacity, and the aforementioned effect of relaxing uneven contact can be expected preferably.

Furthermore, between the temperature retaining unit 53 and the cooling unit 54, the solvents (moisture, organic solvent, etc.) contained in the film F are intended to volatilize (evaporate) because they are at a high temperature, though the EC side of the film F is opened in the cooling unit 14, so that the solvents (moisture, organic solvent, etc.) are not trapped and are volatilized for a longer period of time, so that the image quality is stabilized. As mentioned above, in the rapid process, the cooling time cannot be ignored and it is particularly valid in a rapid process of a heating time of 10 seconds or less.

Figure 3:
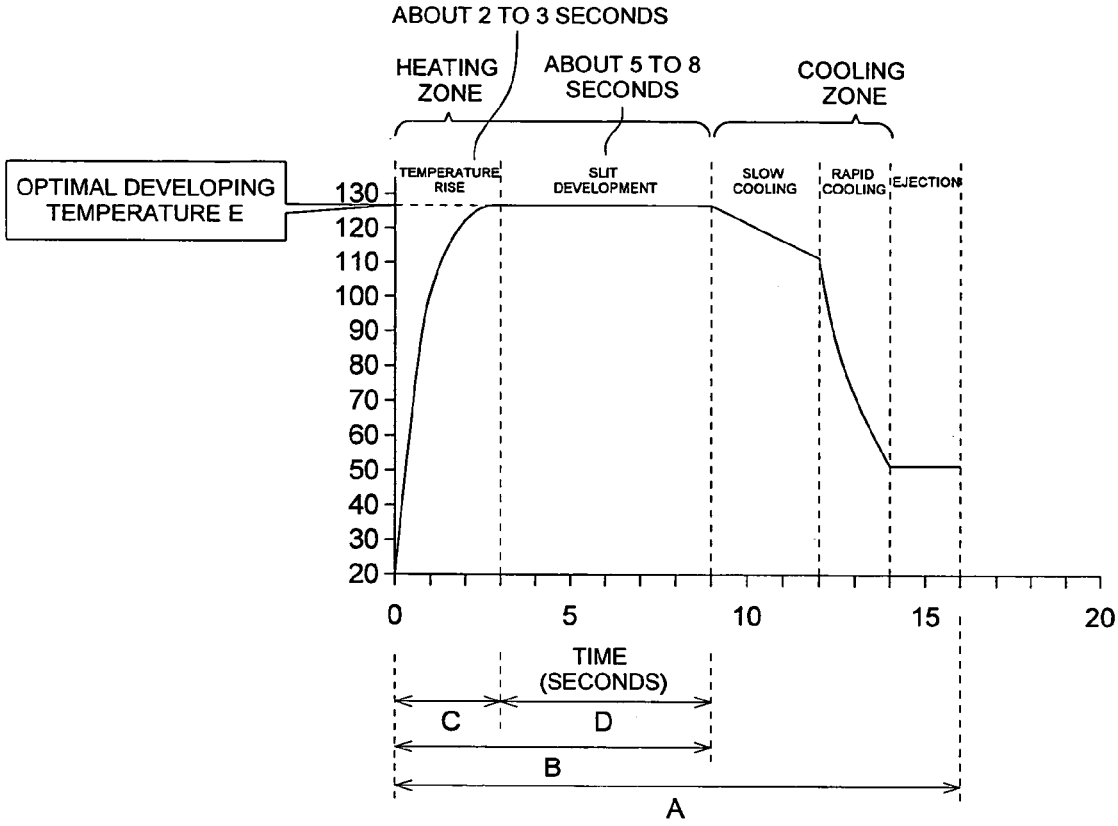
FIG. 3 is a graph showing the temperature profile by the rapid processing method of the heat developing process of the heat developing apparatuses 1 and 40 shown in FIGS. 1 and 2.

Next, the rapid process of the heat developing process in the first and second embodiments will be explained by referring to FIG. 3. FIG. 3 is a graph showing the temperature profile by the rapid processing method of the heat developing process of the heat developing apparatuses 1 and 40 shown in FIGS. 1 and 2.

The rapid processing method, as shown in FIG. 3, to shorten the total processing time A of a film in the heat developing apparatuses 1 and 40 shown in FIGS. 1 and 2, shortens more the heating time B. Therefore, to shorten more the temperature raising time C up to the optimal developing temperature E, the film F in the temperature raising units 10 and 50 is pressed by the opposing rollers 11*a*, 12*a*, 51*a*, and 52*a* and makes closely contact with the fixed guide faces 11*d*, 12*d*, 51*d*, and 52*d*.

And, after the film F reaches the optimal developing temperature E, in the temperature retaining units 13 and 53, the film F is retained at the heat developing temperature for the temperature retaining time D. The temperature retaining units 13 and 53, as described above, convey the film F in the gap (slit) d free of pressing by the opposing rollers and without close contact with the fixed guide faces 13*d* and 53*d*. Further, rapid cooling by the cooling unit shown in FIG. 3 can be realized by arrangement of a heat sink and a cooling fan in the cooling units 14 and 54.

As described above, in the state that the image quality is maintained, the heating time B (temperature raising time C+temperature retaining time D) can be shortened from conventional 14 seconds or so to 10 seconds or less and the total processing time A can be shortened.

Third Embodiment

Figure 4:
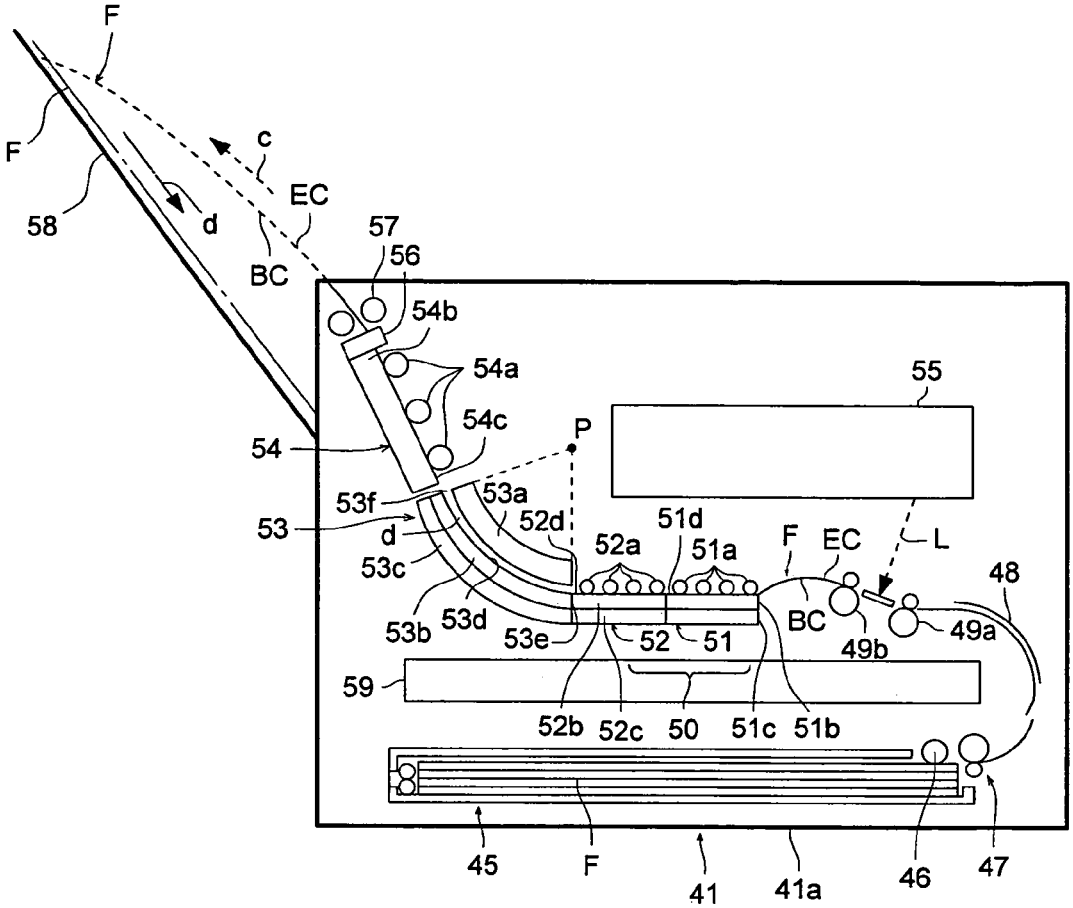
FIG. 4 is a front view schematically showing the essential section of the heat developing apparatus of this embodiment.

FIG. 4 is a side view schematically showing the essential section of the heat developing apparatus of the third embodiment. In FIG. 4, to the elements having the same functions as those of the heat developing apparatus 40 shown in FIG. 2, the same numerals are assigned. As shown in FIG. 4, the heat developing apparatus 41 of this embodiment, by sub-scanning and conveying the sheet film F having the EC side on one side of the sheet support base made of PET and the BC side of the opposite face of the EC side, forms a latent image on the EC side by a laser beam L from the optical scanning exposure unit 55, then heats and develops the film F from the BC side, makes the latent image visible, and conveys and ejects it above the apparatus via the curved conveying path.

The heat developing apparatus 41 shown in FIG. 4 includes the film storage unit 45 for storing many unused films F installed in the neighborhood of the bottom of the apparatus frame 41*a*, the pickup roller 46 for picking up and conveying the uppermost film F of the film storage unit 45, the pair of conveying rollers 47 for conveying the films F from the pickup roller 46, the curved guide 48 formed in a curved shape so as to guide the films F from the pair of conveying rollers 47 and convey them by almost inverting the conveying direction and turning the films F upside down, the pair of conveying rollers 49*a* and 49*b* for sub-scanning and conveying the films F from the curved guide 48, and the optical scanning exposure unit 55 for scanning and exposing the laser beam L to the films F between the pair of conveying rollers 49*a* and 49*b* on the basis of the image data, thereby forming a latent image on the EC side.

The heat developing apparatus 41 additionally includes the temperature raising unit 50 for heating the film F with the latent image formed from the BC side and raising the temperature up to a predetermined heat developing temperature, the temperature retaining unit 53 for heating the temperature-raised film F and retaining the film at the predetermined heat developing temperature, the cooling unit 54 for cooling the heated film F from the BC side, the densitometer 56 arranged on the exit side of the cooling unit 54 for measuring the density of the film F, the pair of conveying rollers 57 for ejecting the film F from the densitometer 56, and the film receiving unit 58 installed on the side of the apparatus frame 41*a* with a gradient so as to temporarily store the film F ejected by the pair of conveying rollers 57.

As shown in FIG. 4, in the heat developing apparatus 41, upward from the bottom of the apparatus frame 41*a*, the film storage unit 45, control unit 59, conveying roller pair 49*a* and 49*b*, temperature raising unit 50, and temperature retaining unit 53 (on the upstream side) are arranged in this order, and the film storage unit 45 is positioned lowest, and the control unit 59 is installed between the temperature raising unit 50 and the temperature retaining unit 53, so that the film storage unit is unlikely to be affected by heat.

Further, the conveying path from the pair of conveying rollers 49*a* and 49*b* for sub-scanning and conveying to the temperature raising unit 50 is formed comparatively short, so that by exposing the film F by the optical scanning exposure unit 55, on the front end side of the film F, the temperature raising unit 50 and the temperature retaining unit 53 execute heat developing heating.

The temperature raising unit 50 and the temperature retaining unit 53 compose a heating unit, which heats the film F up to the heat developing temperature and retains it at the heat developing temperature. The temperature raising unit 50 has the first heating zone 51 for heating the film F on the upstream side up to the heat developing start temperature or lower and the second heating zone 52 for heating it on the downstream side up to the heat developing temperature.

The first heating zone 51 includes the fixed flat heating guide 51*b* made of a metallic material such as aluminum, the flat heater 51*c* composed of a silicone rubber heater adhered to the rear of the heating guide 51*b*, and the plurality of opposing rollers 51*a* having a surface composed of silicone rubber insulating more than metal arranged on the fixed guide face 51*d* of the heating guide 51*b* so as to keep a narrower gap than the film thickness in order to press the film.

The second heating zone 52 includes the fixed flat heating guide 52*b* made of a metallic material such as aluminum, the flat heater 52*c* composed of a silicone rubber heater adhered to the rear of the heating guide 52*b*, and the plurality of opposing rollers 52*a* having a surface composed of silicone rubber insulating more than metal arranged on the fixed guide face 52*d* of the heating guide 52*b* so as to keep a narrower gap than the film thickness in order to press the film.

The temperature retaining unit 53 includes the flat heating guide 53*b* made of a metallic material such as aluminum which is structured at a predetermined curvature and fixed, the curved heater 53*c* composed of a silicone rubber heater adhered to the rear of the curved heating guide 53*b*, and the curved guide section 53*a*, which is structured at a predetermined curvature and is composed of a heat insulating material, arranged opposite to the fixed guide face 53*d* formed on the surface of the heating guide 53*b* so as to have a predetermined gap (slit) d.

In the first heating zone 51 of the temperature raising unit 50, the film F conveyed by the pair of conveying rollers 49*a* and 49*b* from the upstream side of the temperature raising unit 50 is compressed against the fixed guide face 51*d* by the respective opposing rollers 51*a* driven to rotate, thus the BC side makes close contact with the fixed guide face 51*d* and the film F is conveyed by heating the BC side.

Similarly in the second heating zone 52, the film F conveyed from the first heating zone 51 is compressed against the fixed guide face 52*d* by the respective opposing rollers 52*a* driven to rotate, thus the BC side makes close contact with the fixed guide face 51*d*, and the film F is conveyed by heating the BC side.

The film F, in the temperature raising unit 50, is linearly conveyed by the flat fixed guide faces 51*d* and 52*d* of the first and second heating zones 51 and 52 and in correspondence with it, the film F is linearly conveyed toward the first heating zone 51 by the pair of conveying rollers 49*a* and 49*b*, so that the shock when the front end of the film F rushes into the opposing roller 51*a* on the uppermost stream side of the first heating zone 51 is lowered.

In FIG. 4, in the temperature retaining unit 53, a film entering port 53*e* and a film ejection port 53*f* are positioned under the horizontal line passing the curvature center P of the heating guide 53*b* at a predetermined curvature and the angle formed by the film entering port 53*e* of the temperature retaining unit 53 and the film ejection port 53*f* thereof is 90° or less.

In the temperature retaining unit 53, the film F enters the film entering port 53*e* almost horizontally, passes through the gap d between the heating guide 53*b* at the predetermined curvature and the curved guide 53*a*, gradually changes the direction upward by being heated (heat retained), is ejected from the film ejection port 53*f* obliquely in the vertical direction, and is conveyed toward the cooling unit 54. As mentioned above, in the temperature retaining unit 53, the film conveying direction by the opposing rollers 52*a* of the second heating zone 52 on the upstream side is changed to the direction separating from the center P of the curved guide, and the conveying direction thereof is gradually changed in the gap d of the temperature retaining unit 53 by the conveying force of the opposing rollers 52*a* and 51*a*, thus the film is guided slightly obliquely from the counter gravity direction (vertical direction) via the temperature retaining unit 53 with the EC side positioned up.

In the cooling unit 54, the film F conveyed obliquely in the vertical direction from the temperature retaining unit 53 with the EC side positioned up is cooled by making contact with the cooling guide face 54*c* of the cooling plate 54*b* made of a metallic material by opposing rollers 54*a* and is straight conveyed almost linearly and obliquely in the vertical direction. Further, when the cooling plate 54*b* is formed as a finned heat sink structure, the cooling effect can be increased. A part of the cooling plate 54 may be formed as a finned heat sink structure.

The cooled film F sent from the cooling unit 54 is measured for density by the densitometer 56, is conveyed by the pair of conveying rollers 57, and is ejected obliquely in the vertical direction in the direction c of the arrow indicated by the dashed line outside the frame 41*a* with the EC side positioned up, and when the whole film F is ejected outside while the front end of the film F is being guided by the inclined film ejection unit 58, the EC side is positioned straight up, and the end thereof falls obliquely in the gravity direction along the film ejection unit 58 in the direction d of the arrow indicated by the alternate long and short dash line shown in the drawing, and the film F is stored in the film ejection unit 58.

As mentioned above, in the heat developing apparatus 41 shown in FIG. 4, the film F is conveyed when the BC side is directed toward the fixed guide faces 51*d*, 52*d*, and 53*d* in the heated state in the temperature raising unit 50 and the temperature retaining unit 53 and the EC side is opened upward in the opposite direction of the gravity direction. Further, also in the cooling unit 54, the film F is conveyed when the BC side makes contact with the cooling guide face 54*c* and is cooled and the EC side is opened upward in the opposite direction of the gravity direction. Furthermore, until the film F is ejected from the cooling unit 54 outside the apparatus frame 41*a* and is stored in the film ejection unit 58, it is continuously conveyed in the state that the EC side is opened upward in the opposite direction of the gravity direction.

Further, the film F is conveyed by the opposing rollers 51*a* and 52*a* so that in the temperature raising unit 50 and the temperature retaining unit 53, the heating time of the film F becomes 10 seconds or less.

As mentioned above, according to the heat developing apparatus 41 shown in FIG. 4, in the temperature raising unit 50 requiring uniform heat transfer, by the heating guides 51*b* and 52*b* and the plurality of opposing rollers 51*a* and 52*a* for compressing the film F against the heating guides 51*b* and 52*b*, the film F is adhered to the fixed guide faces 51*d* and 52*d*, thus the film F is conveyed by ensuring contact heat transfer. Therefore, high image quality with an occurrence of uneven density suppressed can be obtained.

Further, after temperature raising to the heat developing temperature, even if the temperature retaining unit 53 conveys the film into the gap d between the fixed guide face 53*d* of the heating guide 53*b* and the curved guide 53*a* and heats (the film directly makes contact with the fixed guide face 53*d* and is heated by heat transfer and/or heat transfer by contact with surrounding high-temperature air) in the gap d without particularly being adhered to the fixed guide face 53*d*, the film temperature is controlled within a predetermined range (for example, 0.5° C.) of the developing temperature (for example, 123° C.). As mentioned above, even if the film is conveyed in the gap d along the wall face of the heating guide 53*b* or the wall face of the curved guide 53*a*, a difference in the film temperature is less than 0.5° C. and a uniform temperature retaining state can be kept, so that there is little fear of an occurrence of uneven density in the finished film. Therefore, there is no need to install drive parts such as rollers in the temperature retaining unit 53, thus the number of parts can be reduced.

Further, films are guided in the counter gravity direction via the temperature retaining unit 53 and guided obliquely in the vertical direction toward the cooling unit 54 from the temperature retaining unit 53, so that compared with films conveyed vertically, the posture of films conveyed can be stabilized, and in the gap d, volatile substances generated in the temperature retaining unit 53 become an up-current and are preferably ejected easily from the temperature retaining unit 53.

Furthermore, the heating time for the film F is 10 seconds or less, so that a rapid heat developing process can be realized, and the temperature retaining unit 53 is structured so as to be formed in a curved shape and be directed obliquely in the vertical direction, and the film F is ejected from the cooling unit 54 to the film receiving unit 58 straight in the oblique direction. Therefore, the cooling unit 54 is formed at a predetermined curvature according to the apparatus layout, thus miniaturization of the installation area and miniaturization of the overall apparatus can be realized.

In a conventional large-sized apparatus, for the part operated sufficiently by the temperature retaining function after films are raised to the developing temperature, the same heating conveying constitution as that of the temperature raising unit is adopted, so that unnecessary members are used after all, and increasing in the number of parts and increasing in cost are caused, and in a conventional small-sized apparatus, a problem arises that heat transfer at time of temperature raising cannot be guaranteed, so that density irregularities are caused, and high image quality can be unlikely to be guaranteed. On the other hand, according to this embodiment, the heat developing process is executed separately in the temperature raising unit 50 and the temperature retaining unit 53, thus the problems aforementioned can be dissolved.

Further, the film F is heated from the BC side by the temperature raising unit 50 and the temperature retaining unit 53 when the EC side is opened, thus when executing the heat developing process by the rapid process of 10 seconds or less, by opening the EC side, the solvents (moisture, organic solvent, etc.) contained in the film F which are heated and intended to volatilize (evaporate) are almost scattered out at the shortest distance, so that even if the heating time (volatilization time) is shortened, the sheet film is unlikely to be affected by the shortened time, and even if there is a part where the contact between the film F and the fixed guide faces 51*d* and 52*d* is bad, by the heat diffusion effect by the PET base of the BC side, a temperature difference from the part where the contact is satisfactory is relaxed, and as a result, a density difference is unlikely to appear, so that the density can be stabilized, and the image quality becomes stable. Further, generally, in consideration of the heating efficiency, heating of the EC side is considered to be better. However, in consideration of that the thermal conductivity of the PET of the support base of the film F is 17 W/m ° C. and the thickness of the PET base is about 170 μm, the time delay is a little, and it can be offset easily by increasing the heater capacity, and the aforementioned effect of relaxing uneven contact can be expected preferably.

Furthermore, between the temperature retaining unit 53 and the cooling unit 54, the solvents (moisture, organic solvent, etc.) contained in the film F are intended to volatilize (evaporate) because they are at a high temperature, though the EC side of the film F is opened in the upward direction opposite to the gravity direction in the cooling unit 54, so that the solvents (moisture, organic solvent, etc.) are not trapped, are easily volatilized at the shortest distance from the film F, and are volatilized for a longer period of time, and furthermore the film F is ejected outside the apparatus frame in the state that the EC side is opened in the upward direction opposite to the gravity direction and is stored in the film ejection unit 58. Therefore, the solvents are continuously volatilized at the shortest distance from the film between cooling and outside conveyance, and the image quality (density) is stabilized more. As mentioned above, in the rapid process, the cooling time cannot be ignored and it is particularly valid in the rapid process of a heating time of 10 seconds or less.

Figure 5:
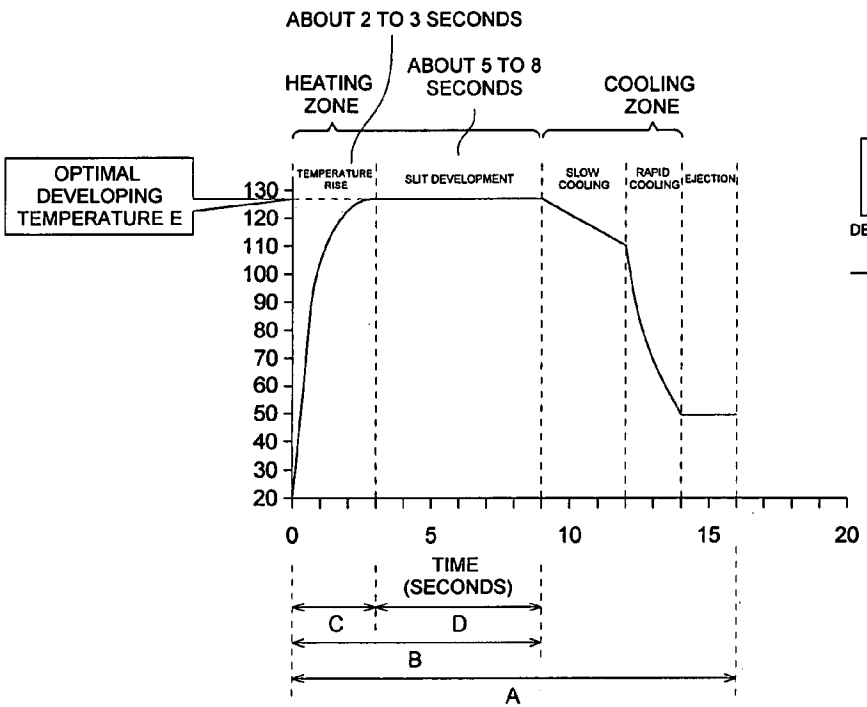
FIG. 5(*a*) is a graph showing the temperature profile by the first rapid processing method of the heat developing process of the heat developing apparatus 41 shown in FIG. 4 and FIG. 5(*b*) is a graph showing the temperature profile by the second rapid processing method.
Figure 5:
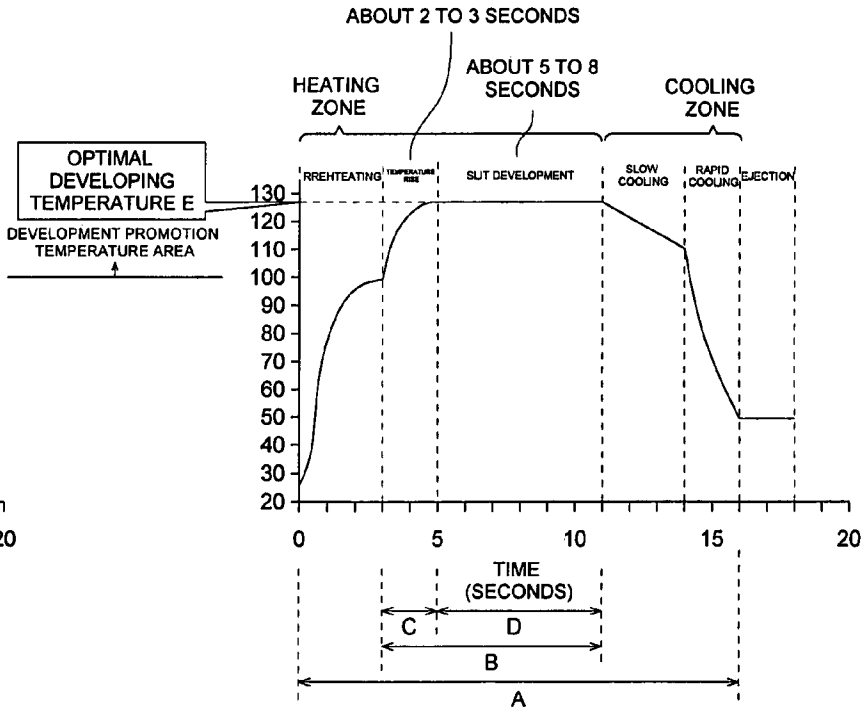

Next, the rapid process of the heat developing process in this embodiment will be explained by referring to FIG. 5. FIG. 5(*a*) is a graph showing the temperature profile by the first rapid processing method of the heat developing process of the heat developing apparatus 41 shown in FIG. 4 and FIG. 5(*b*) is a graph showing the temperature profile by the second rapid processing method.

The first rapid processing method, as shown in FIG. 5(*a*), to shorten the total processing time A of a film in the heat developing apparatuses 41 shown in FIG. 4, shortens more the heating time B. Therefore, to shorten more the temperature raising time C up to the optimal developing temperature E, the film F in the temperature raising unit 50 is pressed by the opposing rollers 51*a* and 52*a* and makes closely contact with the fixed guide faces 51*d* and 52*d* for rapid heat transfer from the guide faces to the film.

And, after the film F reaches the optimal developing temperature E, in the temperature retaining unit 53, the film F is retained at the heat developing temperature for the temperature retaining time D. The temperature retaining unit 53, as described above, conveys the film F in the gap (slit) d free of pressing by the opposing rollers and without close contact with the fixed guide face 53*d*. Further, rapid cooling by the cooling unit shown in FIG. 5(*a*) can be realized by arrangement of a heat sink and a cooling fan in the cooling unit 54.

As described above, the heating time B (temperature raising time C+temperature retaining time D) can be shortened from conventional 14 seconds or so to 10 seconds or less and the total processing time A can be shortened.

Further, the second rapid processing method, as shown in FIG. 5(*b*), to shorten the total processing time A of the film F in the heat developing apparatus 41 shown in FIG. 4, shortens more the heating time B for heating in the temperature area of 100° C. or higher at which a developing reaction occurs in the film F. Therefore, to shorten more the temperature raising time C up to the optimal developing temperature E, the film F is pressed by the opposing rollers 52*a* in the second heating zone 52 of the temperature raising unit 50 and makes closely contact with the fixed guide face 51*d*.

And, after the film F reaches the optimal developing temperature E, in the temperature retaining unit 53, the film F is retained at the heat developing temperature for the temperature retaining time D. The temperature retaining unit 53, as described above, conveys the film F in the gap (slit) d free of pressing by the opposing rollers and without close contact with the fixed guide face 53*d*. Further, rapid cooling by the cooling unit shown in FIG. 5(*b*) can be realized by arrangement of a heat sink and a cooling fan in the cooling unit 54.

As described above, the heating time B (temperature raising time C+temperature retaining time D) can be shortened from conventional 14 seconds or so to 10 seconds or less and the total processing time A can be shortened.

Further, the temperature raising unit 50, as shown in FIG. 5(*b*), so as to preliminarily heat the film F up to the heat developing start temperature (for example, 100° C.) or lower in the first heating zone 51 on the upstream side and heat it up to the heat developing temperature in the second heating zone 52 on the downstream side, independently controls the temperatures of the heaters 51*c* and 52*c* of the respective heating zones 51 and 52, and heats the film F up to the heat developing start temperature or lower from the room temperature on the upstream side, thus particularly the load variation of the heater 52*c* is decreased than raising the temperature from the room temperature to the heat developing temperature, so that the temperature control characteristic when raising the temperature up to the heat developing temperature by the heater 52*c* on the downstream side can be improved, and the temperature variation in the second heating zone 52 in the development promotion area can be suppressed, and the wrinkle-shaped deformation of the film F due to rapid thermal expansion can be suppressed.

As described above, according to the heat developing apparatus of this embodiment, particularly the effect of suppression of the installation area occupation and maintenance of the image quality is produced, and particularly in a small-sized apparatus, an up-current of air is generated in the heating zone thereof, and the temperature is easily raised, so that it is preferable to install the film storage unit 45 on the bottom of the apparatus, and when the storage unit 45 installed on the bottom is used, the occupied area is not increased preferably. Further, in the film storage unit 45, the film F is arranged with the EC side directed downward, so that the solvent volatilization from the EC side of either of the uppermost film and lowermost film is easily held constant, and no foreign substances are accumulated, so that fine white spots are unlikely to be formed.

EXAMPLES

Example 1

Figure 7:
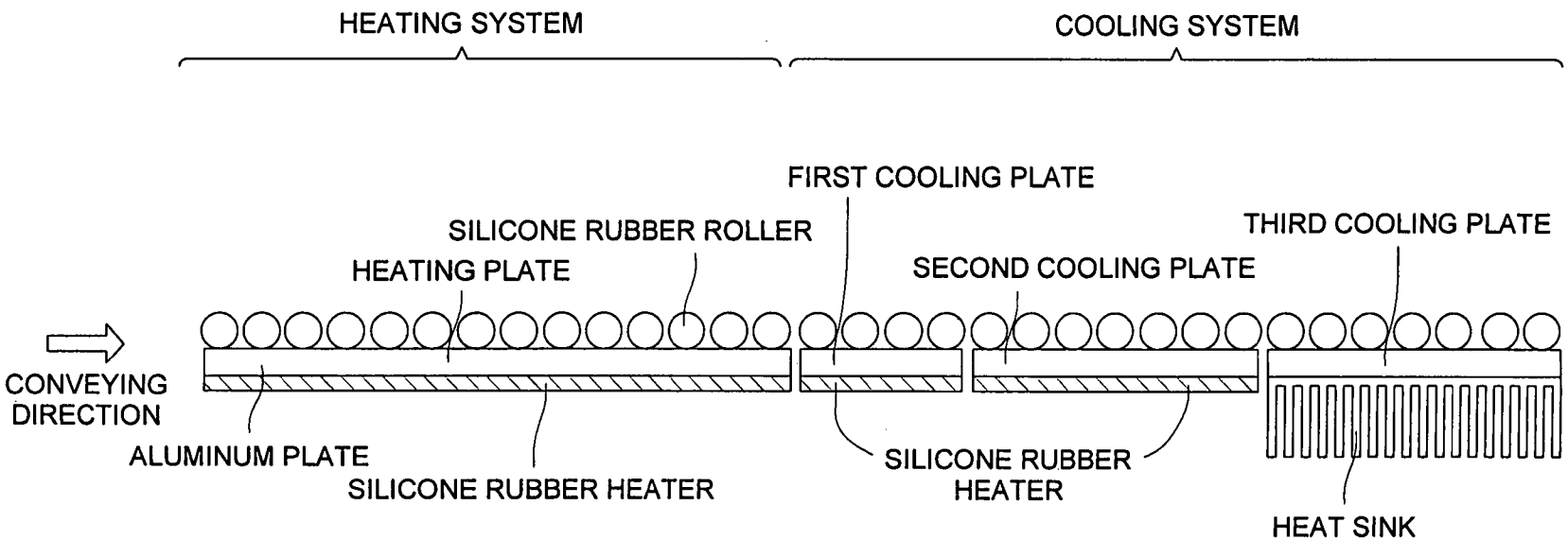
FIG. 7 is a view showing the constitution of the essential section of the heat developing apparatus used in Example 1.

Next, in Example 1, the effect of heating of the BC side and opening of the EC side in the heating process of the rapid process will be explained. The heat developing apparatus shown in FIG. 7 is used for experimentation and the constitution thereof is as indicated below.

As a heating system, a heating plate composed of an aluminum plate with a thickness of 10 mm with a silicone rubber heater attached is used. On the guide face of the heating plate, a silicone rubber roller with a diameter of 12 mm and an effective conveying length of 380 mm having a silicone rubber layer with a thickness of 1 mm as a surface layer is arranged at a linear pressure of about 8 gf/cm, and a film with a heat developing photosensitive material coated is compressed by the silicone rubber roller and is conveyed by making the BC side contact with the heating plate. The conveying length of the heating plate is 210 mm.

As a cooling system, the first to third cooling plates use an aluminum plate with a thickness of 10 mm, and the first and second cooling plates respectively have an installed silicone rubber heater, thus the cooling temperature can be controlled, and to the rear of the aluminum plate of the third cooling plate, a heat sink having 21 fins with a thickness of 0.7 mm, a height of 35 mm, and a depth of 390 mm arranged at a pitch of 4 mm is connected. On the first to third cooling plates, a silicone rubber roller with a diameter of 12 mm and an effective conveying length of 380 mm having a silicone rubber layer with a thickness of 1 mm as a surface layer is arranged at a linear pressure of about 8 gf/cm and a film is conveyed by being compressed. The conveying lengths of the first to third cooling plates are respectively 60 mm, 105 mm, and 105 mm.

The conveying speed, in the normal process, is set to 15.1 mm/s and in the rapid process, is changed to 21.2 mm. The temperature of the heating plate is set to 123° C., the temperature of the first cooling plate to 110° C., the temperature of the second cooling plate to 90° C., and the temperature of the third cooling plate to 30 to 60° C. Between the heating plate and the cooling plates, a gap of 2 mm is provided to suppress heat movement between the plates.

The heat developing film is SD-P manufactured by Konica Minolta Co., Ltd. which is a heat developing film of the organic solvent system as disclosed in Japanese Patent Application 2004-102263.

The aforementioned films are left in three environments such as normal (25° C., 50% RH), high humidity (25° C., 80% RH), and low humidity (25° C., 20% RH) to get to fit them. (By doing this, the water content in the films is changed.)

Using these films, the heat developing process by the heat developing apparatus shown in FIG. 7 is executed. Namely, in Example 1, each film is conveyed by opening the EC side with a coating liquid coated and compressing it by the silicone rubber roller and making the BC side contact with the heating plate, and the heating time B shown in FIG. 3 is set to 10 seconds, and the heat development is executed (EC side opened, BC side heated, rapid process).

In Comparison Example 1, the heat development is executed under the same condition as that of Example 1 except that each film is turned upside down, and the BC side is opened, and the EC side is heated (BC side opened, EC side heated, rapid process).

In Comparison Example 2, the heat development is executed under the same condition as that of Example 1 except the normal process that the EC side is opened, and the BC side is heated, and the heat time B is 14 seconds (EC side opened, BC side heated, normal process).

In Comparison Example 3, the heat development is executed under the same condition as that of Example 1 except the normal process that the BC side is opened, and the EC side is heated, and the heat time B is 14 seconds (BC side opened, EC side heated, normal process).

FIGS. 8(*a*) and 8(*b*) are drawings showing the sensitocurve (γ curve) indicating the relationship between the exposure amount and the density of Example 1 and Comparison Example 1 of the rapid process. FIGS. 9(*a*) and 9(*b*) are drawings showing the sensitocurve (γ curve) indicating the relationship between the exposure amount and the density of Comparison Examples 2 and 3 of the normal process.

As shown in FIGS. 9(*a*) and 9(*b*), in the conventional normal process, in both heating of the BC side and heating of the EC side, regardless of normal, high humidity, and low humidity, no so great difference appears in the absolute density/sensitocurve.

On the other hand, as shown in FIGS. 8(*a*) and 8(*b*), when the rapid process is performed, in heating of the EC side of Comparison Example 1, the sensitocurve is changed considerably between normal, high humidity, and low humidity, while in heating of the BC side of Example 1, the sensitocurve is not changed no much and is varied only to the degree of Comparison Example 3, thereby can be maintained similarly to the conventional normal process. The reason is considered to be that the EC side is opened and the BC side is heated, thus the residual solvents (moisture, organic solvent, etc.) contained in the film which are heated and intended to volatilize (evaporate) are almost scattered out at the shortest distance, so that even if the heating time (volatilization time) is shortened, the film is unlikely to be affected by the shortened time. Furthermore, also in the cooling system, the EC side of the film is opened, so that moisture is not trapped, and the solvents are volatilized for a longer period of time, thus it is considered that the film is unlikely to be affected by the shortened time.

Example 2

Figure 10:
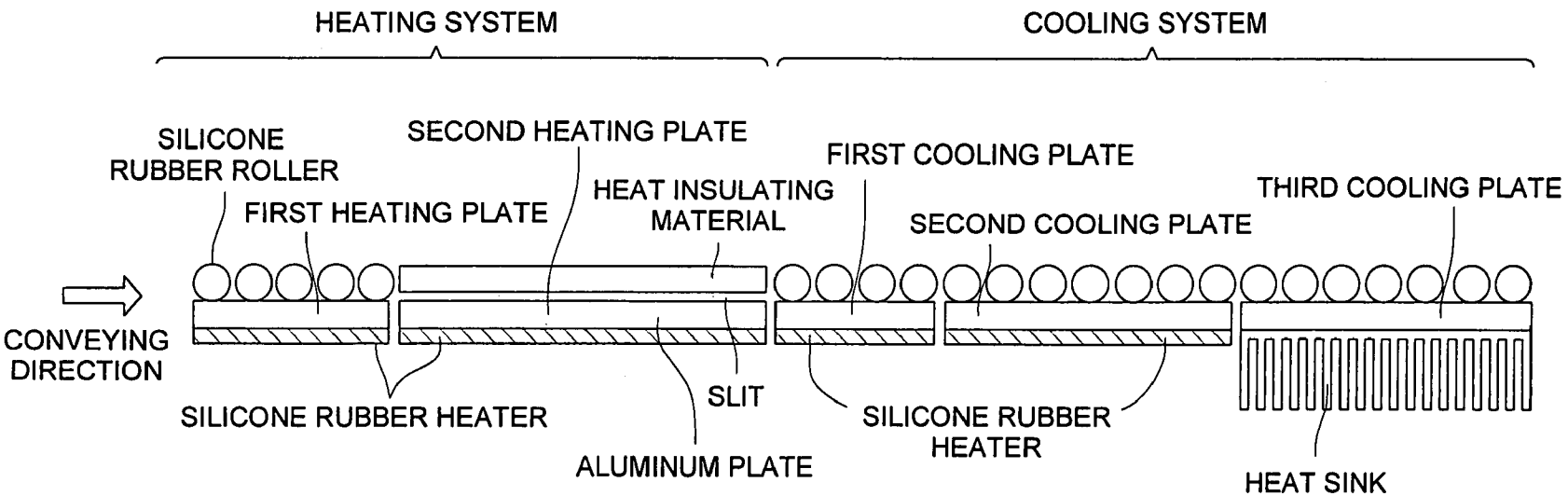
FIG. 10 is a view showing the constitution of the essential section of the heat developing apparatus used in Example 2.

Next, in Example 2, the gap (slit) heating effect by the temperature retaining unit will be explained. In this example, the heat developing apparatus shown in FIG. 10 is used in the experimentation. In the heat developing apparatus, in FIG. 7, the upstream side of the heating system is a first heating plate, and the downstream side thereof is a second heating plate with the rubber roller omitted, and the heating system is covered with a heat insulating material, thus the film passing portion is formed in a slit shape, and the slit is heated. The slit interval between the second heating plate and the heat insulating material is 3 mm.

Figure 11:
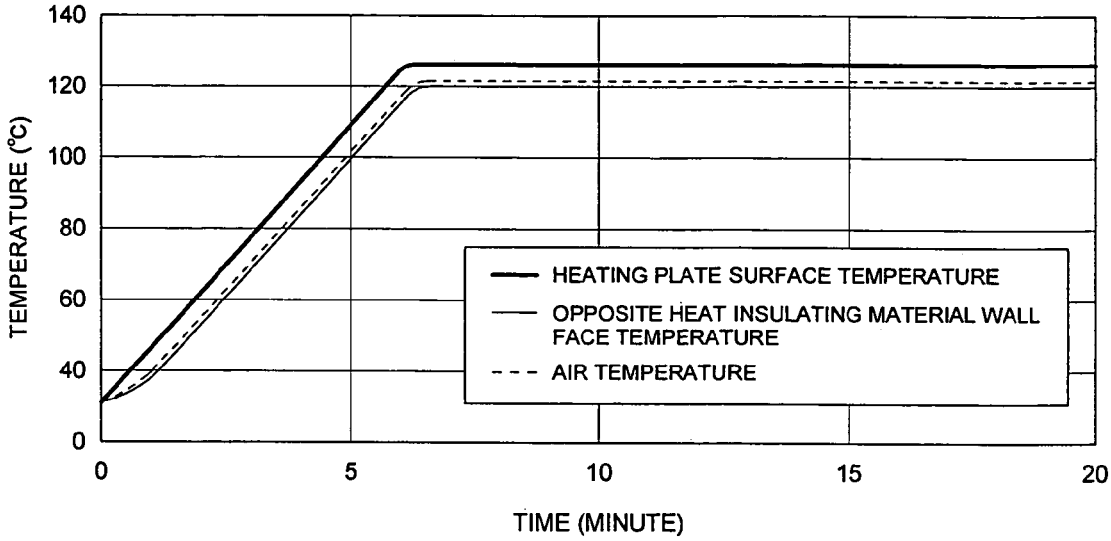
FIG. 11 is graphs showing the relationship between the time and the temperature in Example 2 when the heating plate surface temperature in the slit shown in FIG. 10, the heat insulating material wall surface temperature opposite to the heating plate surface, and the air temperature in the slit are measured from temperature raising start up to the heat developing temperature.

The heating plate surface temperature in the slit shown in FIG. 10, the heat insulating material wall surface temperature opposite to the heating plate surface, and the air temperature in the slit are measured from temperature raising start up to the heat developing temperature and the relationship between the time and the temperature is shown in FIG. 11.

Figure 12:
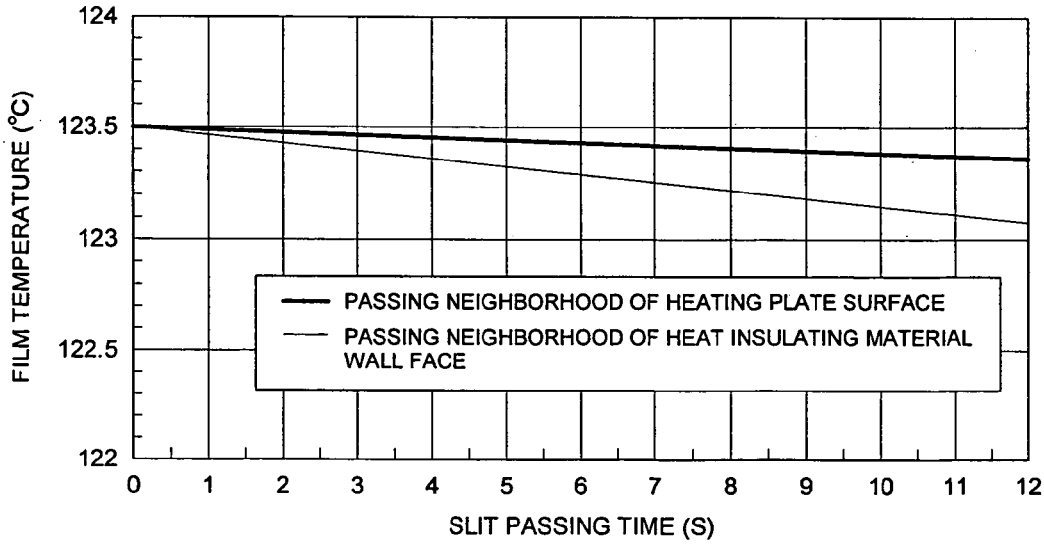
FIG. 12 is graphs showing changes in the film temperature in Example 2 when a film passes the neighborhood of the heating plate surface in the slit and passes the neighborhood of the heat insulating material wall surface.

FIG. 12 shows changes in the film temperature when the film passes the neighborhood of the heating plate surface in the slit and passes the neighborhood of the heat insulating material wall surface.

As shown in FIG. 11, after the film reaches the heat developing temperature, the heat insulating material wall face temperature and the air temperature in the slit are almost fixed and almost coincide with each other and are lower than the heating plate surface temperature by about 3° C.

As shown in FIG. 12, when the slit interval is 3 mm or less and the temperature retaining time is 8 seconds or less and the film passes the neighborhood of the heating plate surface in the slit, the film temperature is slightly lowered from the developing temperature 123° C., and when the film passes the neighborhood of the heat insulating material wall face, the film temperature is lowered than that when the film passes the neighborhood of the heating plate surface, though both film temperatures differ from the developing set temperature (123° C.) by less than 0.5° C. and the differences are within a range that the effect on the density can be ignored. Therefore, the slit interval of the temperature retaining unit can be set to less than 3 mm, and the tolerances to curvature errors when both guides are processed and to the mounting precision are increased, and the degree of freedom of design is increased greatly.

Figure 13:
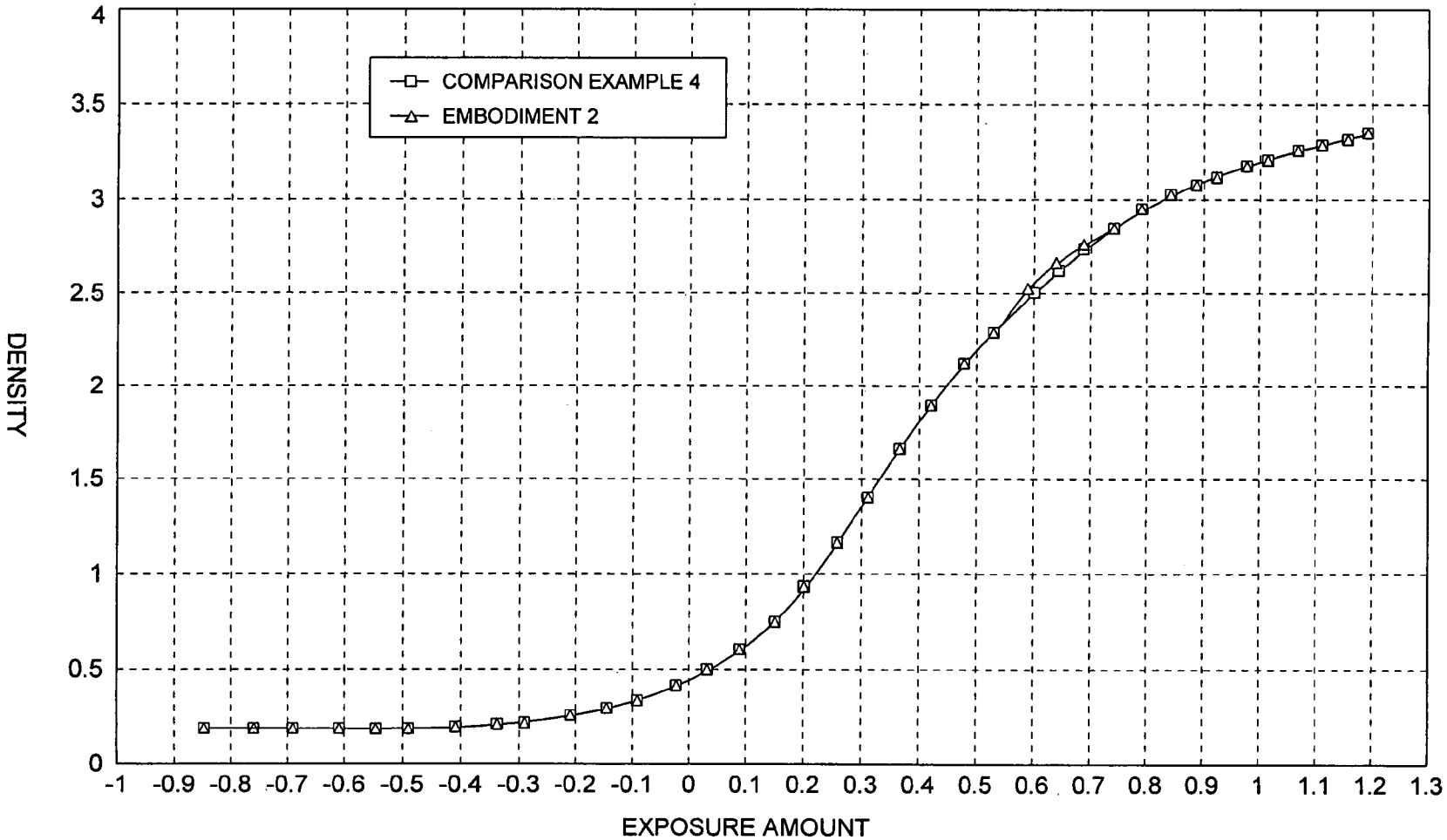
FIG. 13 is a drawing showing the sensitocurve (γ curve) indicating the relationship between the exposure amount and the density obtained from Example 2 and Comparison Example 4.

In Example 2, the heat developing process is executed using the heat developing apparatus shown in FIG. 10. The sensitocurve (γ curve) indicating the relationship between the exposure amount and the density obtained at that time is shown in FIG. 13. Further, in Comparison Example 4, the heat developing process is executed under the same condition except use of the heat developing apparatus shown in FIG. 7 and the sensitocurve (γ curve) indicating the relationship between the exposure amount and the density obtained at that time is also shown in FIG. 13.

As shown in FIG. 13, after the film reaches the heat developing temperature, when a case that the film is adhered to the heating plate surface by the opposing rollers and are heated (Comparison Example 4) and a case that the film is heated in the slit (Example 2) are compared, there is little difference in the sensitocurve and almost same results can be obtained.

Figure 6:
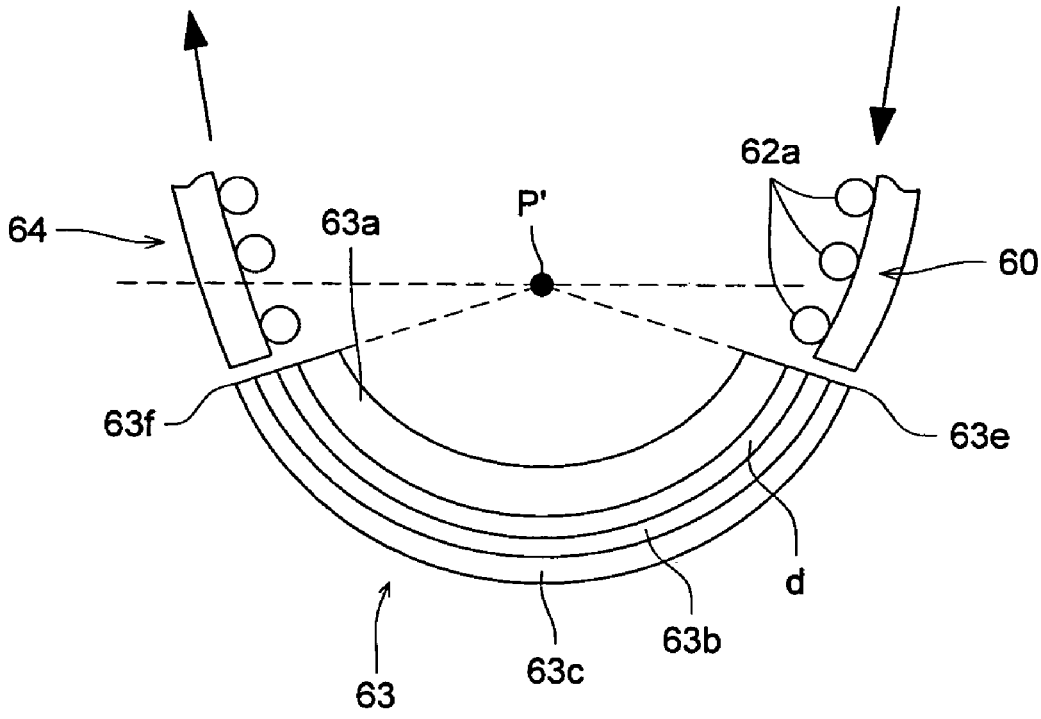
FIG. 6 is a view of the essential section schematically showing a modification of the temperature retaining unit of the heat developing apparatus shown in FIG. 4.

The preferred embodiments of the present invention are explained above. However, the present invention is not limited to these embodiments and can be modified variously within the scope of technical though. For example, the temperature retaining unit 53 shown in FIG. 4 may be structured as shown in FIG. 6. Namely, a temperature retaining unit 63 shown in FIG. 6 includes a fixed heating guide 63*b* which is made of a metallic material such as aluminum and is formed at a predetermined curvature, a curved heater 63*c* composed of a silicone rubber heater adhered to the rear of the curved heating guide 63*b*, and a curved guide 63*a* which is arranged opposite to a fixed guide face 63*d* formed on the surface of the heating guide 63*b* so as to have a predetermined gap (slit) d, is formed at a predetermined curvature, and is composed of a heat insulating material.

To a film entering port 63*e* of the temperature retaining unit 63 shown in FIG. 6, the film is conveyed obliquely downward from a temperature raising unit 60 structured almost similarly to the temperature raising unit 50 shown in FIG. 4. The film entering port 63*e* and a film ejection port 63*f* of the temperature retaining unit 63 are positioned under the horizontal line passing the curvature center P' of the heating guide 63*b* at a predetermined curvature and the angle formed by the film entering port 63*e* and the film ejection port 63*f* is within the range from 90° to less than 180° on the basis of the curvature center P'. The film heated (heat retained) by the temperature retaining unit 53 is conveyed obliquely in the vertical direction from the film ejection port 63*f* of the temperature retaining unit 63 and is guided toward a cooling unit 64 structured almost similarly to the cooling unit 54 shown in FIG. 4. As mentioned above, in the temperature retaining unit 64, the film conveying direction by opposing rollers 62*a* of the temperature raising unit 60 on the upstream side is a direction separating from the center P' of the curvature guide, and the conveying direction is slowly changed from downward to upward in the gap d of the temperature retaining unit 64 by the conveying force by the opposing rollers 62*a*, thus the film is guided obliquely in the counter gravity direction via the temperature retaining unit 64. As mentioned above, the film leaves the temperature retaining unit 63 when the EC side is opened in the upward direction opposite to the gravity direction and is guided to the cooling unit 64, and furthermore is conveyed from the cooling unit 64 in the state that the EC side is opened in the upward direction opposite to the gravity direction until it is stored in the film ejection unit outside the apparatus frame similar to that shown in FIG. 4.

As mentioned above, between the temperature retaining unit 63 and the cooling unit 64, the solvents (moisture, organic solvent, etc.) contained in the film are intended to volatilize (evaporate) because they are at a high temperature, though the EC side of the film is opened in the upward direction opposite to the gravity direction in the cooling unit 64, so that the solvents (moisture, organic solvent, etc.) are not trapped, are easily volatilized at the shortest distance from the film, and are volatilized for a longer period of time, and furthermore the film F is ejected outside the apparatus frame in the state that the EC side is opened in the upward direction opposite to the gravity direction and is stored in the film ejection unit. Therefore, the solvents are continuously volatilized at the shortest distance from the film between cooling and outside conveyance, and the image quality (density) is stabilized more.

Further, in the temperature retaining unit 63 shown in FIG. 6, similarly to the temperature retaining unit 53 shown in FIG. 4, there is no need to install drive parts such as rollers, so that the number of parts can be reduced, and the film F is guided in the counter gravity direction via the temperature retaining unit 63 and guided toward the cooling unit 64 by the curvature guide of the temperature retaining unit 63 under the curvature center P', so that compared with films conveyed vertically, the posture of films conveyed can be stabilized, and in the gap d, volatile substances generated in the temperature retaining unit 63 become an up-current of air and are ejected easily from the temperature retaining unit 63.

Further, in this embodiment, when producing films, an organic solvent series solvent is used, though a water series solvent can be used. Heat developing films using a water series solvent are produced as indicated below.

Namely, a PET film is coated with a coating liquid containing water of 30 wt % or more of the solvent in an organic silver salt containing layer, is dried, and formed and a heat developing photosensitive film with a thickness of 200 μm is produced. The binder of the organic silver salt containing layer can be dissolved or scattered in a water series solvent (water solvent) and is composed of latex of a polymer having an equilibrium moisture content of 2 wt % or less at 25° C. and 60% RH. The water series solvent composed of the polymer which can be dissolved or scattered is water or water mixed with a water-miscible organic solvent of 70 wt % or less. As a water-miscible organic solvent, for example, the alcohol based solvents such as methyl alcohol, ethyl alcohol, and propyl alcohol, the Cellosolve based solvents such as methyl Cellosolve, ethyl Cellosolve, and butyl Cellosolve, ethyl acetate, and dimethylformamide may be cited.

Concretely, the emulsion layer (photosensitive layer) coating liquid is prepared as indicated below. To a fatty acid dispersion of 1000 g and water of 276 ml, a pigment—1 dispersion, an organic polyhalogen compound—1 dispersion, an organic polyhalogen compound—2 dispersions, a butadiene compound—1 solvent, and SBR latex (Tg, 17° C.) liquid, a reducing agent—1 dispersion, a reducing agent—2 dispersions, a hydrogen bonding compound—1 dispersion, a developing promoter—1 dispersion, a developing promoter—2 dispersions, a color adjusting agent—1 dispersion, a mercapto-compound—1 water solution, and a mercapto-compound—2 water solutions are added sequentially, and a silver halide mixed emulsion is added immediately before coating, and the emulsion layer coating liquid obtained by sufficiently mixing them is sent straight to the coating die and is coated.

What is claimed is:

1. A heat developing apparatus, comprising:

a heating section which heats a sheet film, which includes a support base and a photosensitive layer which is composed of heat developing photosensitive material coated on the support base, for no less than 5 seconds and no more than 10 seconds; and a cooling section which cools the heated sheet film, which is heated by the heating section, wherein the outer surface of the support base composes a support base side and the outer surface of the photosensitive layer composes a photosensitive layer side, and the heating section heats the sheet film from the support base side with the photosensitive layer side being open to an ambient atmosphere, and then the cooling section cools the heated sheet film from the support base side with the photosensitive layer side being open to the ambient atmosphere upwardly so that volatilized solvents from the photosensitive layer are not trapped.

2. The heat developing apparatus according to claim 1, wherein the cooling section includes a heat sink which cools the cooling section on the opposite side of the cooling section to the side which touches the sheet film.

3. The heat developing apparatus according to claim 1, further comprising:

an ejecting section which ejects the sheet film cooled by the cooling section from the cooling section with the photosensitive layer side being open to the ambient atmosphere upward and opposite the gravity direction.

4. A heat developing apparatus, comprising:

a heating section which heats a sheet film, which includes a support base and a photosensitive layer which is composed of heat developing photosensitive material coated on the support base, for no less than 5 seconds and no more than 10 seconds;

a cooling section which cools the heated sheet film, which is heated by the heating section; and a conveying section which conveys the heated sheet film from the heating section onto the cooling section, wherein the outer surface of the support base composes a support base side and the outer surface of the photosensitive layer composes a photosensitive layer side, and the heating section heats the sheet film from the support base side with the photosensitive layer side being open to an ambient atmosphere, then the conveying section conveys the sheet film from the heating section to the cooling section, and the cooling section cools the sheet film, the photosensitive layer side being open to the ambient atmosphere upwardly during the heating and the cooling so that volatilized solvents from the photosensitive layer are not trapped.

5. A heat developing apparatus according to claim 4, wherein the cooling section cools the heated sheet film with the photosensitive layer side being open.

6. The heat developing apparatus according to claim 4, wherein the conveying section conveys the heated sheet film from the heating section onto the cooling section with the photosensitive layer aide being open to the ambient atmosphere at least at the end of the cooling section which is nearer to the heating section than the other end.

7. The heat developing apparatus according to claim 5, wherein the cooling section includes a curved surface which touches the sheet film and changes the direction of conveying the sheet.

* * * * *